US006384532B1

(12) United States Patent
Yoshioka et al.

(10) Patent No.: US 6,384,532 B1
(45) Date of Patent: May 7, 2002

(54) PLASMA DISPLAY PANEL AND METHOD OF FABRICATING THE SAME

(75) Inventors: Toshihiro Yoshioka; Akira Miyakoshi, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/415,106

(22) Filed: Oct. 8, 1999

(30) Foreign Application Priority Data

Oct. 8, 1998 (JP) ..... 10-286767

(51) Int. Cl.[7] ..... H01J 17/49
(52) U.S. Cl. ..... 313/586; 313/582
(58) Field of Search ..... 313/582, 584, 313/586, 587

(56) References Cited

FOREIGN PATENT DOCUMENTS

| | | |
|---|---|---|
| JP | 8-315734 | 11/1996 |
| JP | 9-330665 | 12/1997 |
| JP | 10-92326 | 4/1998 |
| JP | 10-233171 | 9/1998 |
| JP | 11-96919 | 4/1999 |
| JP | 11-233026 | 8/1999 |
| JP | 11-297215 | 10/1999 |

*Primary Examiner*—Vip Patel
(74) *Attorney, Agent, or Firm*—Scully, Scott, Murphy & Presser

(57) ABSTRACT

A plasma display panel having an improved display quality with low power consumption is provided. Pairs of first and second sustain electrodes are formed on the inner surface of a first substrate to extend in a first direction. A first dielectric layer is formed on the inner surface of the first substrate to cover the pairs of first and second sustain electrodes. Selection electrodes are formed on the inner surface of a second substrate to extend in a second direction perpendicular to the first direction. A second dielectric layer is formed on the inner surface of the second substrate to cover the selection electrodes. Partition walls are formed in the gap between the first and second substrates to extend in the second direction, thereby forming discharge spaces in the gap. Fluorescent layers are formed in the respective discharge spaces. A discharge gas is introduced in the discharge spaces. An overlapping part of the first dielectric layers with the first sustain electrodes has a non-uniform thickness in the width-wise direction of the first sustain electrode. An overlapping part of the first dielectric layers with the second sustain electrodes has a non-uniform thickness in the widthwise direction of the second sustain electrode. The non-uniform thickness is realized by protrusions or depressions for the first dielectric layer.

29 Claims, 24 Drawing Sheets

PLASMA DISPLAY PANEL AND METHOD OF FABRICATING THE SAME

BACKGROUND OF THE INVENTION

1. Field of the Invention

The present invention relates to a plasma display panel (PDP) and a method of fabricating the same and more particularly, to a PDP having pairs of sustain electrodes that extend in parallel and covered with a dielectric layer and selection electrodes that extend perpendicular to the pairs of sustain electrodes, and a method of fabricating the PDP.

2. Description of the Prior Art

PDPs can be readily fabricated as large-sized flat display panels and therefore, they have been used for display devices of personal computers and workstations, wall-mounted television (TV) sets, and so on.

An example of the configuration of prior-art PDPs is shown in FIGS. 1A to 1C, which is of the surface-discharge type.

As shown in FIGS. 1A to 1C, this prior-art PDP includes first and second components 101 and 102 coupled together. The components 101 and 102 are of a plate shape.

The first component 101 has a first lass substrate 111, pairs of strip-shaped sustain electrodes 112 and 115 formed on the inner flat surface of the substrate 111, a dielectric layer 113 formed on the inner surface of the substrate 111 to cover the pairs of sustain electrodes 112 and 115, and a magnesium oxide (Mg0) layer 114 formed on the dielectric layer 113. The pairs of sustain electrodes 112 and 115, which extend in parallel to each other, are arranged at a specific pitch. Each of the sustain electrodes 112 is apart from a corresponding (or pair-forming) one of the sustain electrodes 115 by a specific distance. The dielectric layer 113 is made of low melting-point glass such as lead monoxide (Pb0)-system glass. The Mg0 layer 114 is used to protect the dielectric layer 113.

On the other hand, the second component 102 has a second glass substrate 121, strip-shaped selection electrodes 122 formed on the inner flat surface of the substrate 121, a dielectric layer 123 formed on the inner surface of the substrate 121 to cover the selection electrodes 122, partition walls 125 formed on the dielectric layer 123 to extend in parallel to the selection electrodes 122, and strip-shaped fluorescent layers 124 formed on the dielectric layer 123. The selection electrodes 122, which are perpendicular to the pairs of strip-shaped sustain electrodes 112 and 115, are arranged at a specific pitch. The partition walls 125 protrude vertically from the surface of the dielectric layer 123 and contacted with the opposing Mg0 layer 114 of the first component 111, resulting in strip-shaped discharge spaces 103 extending along the walls 125 between the first and second components 101 and 102. Each of the spaces 103 includes a corresponding one of the selection electrodes 122 located at the center of the corresponding space 103. The fluorescent strips 124 cover not only the exposed surface of the dielectric layer 123 but also the side faces of the partition walls 125, as shown in FIG. 1C.

The first and second components 101 and 102 are couples together so that the Mg0 layer 114 is opposed to the dielectric layer 123 at a specific distance. A discharge gas (not shown) is filled into the discharge spaces 103 to emit ultraviolet (UV) light for the purpose of exciting the fluorescent stripes 124. As shown in FIG. 1A, areas (approximately rectangular in shape) near the intersections of the pair of sustain electrodes 112 and 115 and the selection electrodes 122 form unit light-emitting areas, i.e., cells 105.

On operation of the prior-art PDP shown in FIGS. 1A to 1C, a specific voltage is applied across the pairs of sustain electrodes 112 and 115 to thereby generate and sustain electric discharge in the gas filled in the discharge spaces 103. Due to this electric discharge, UV light is emitted from the gas and irradiated to the fluorescent stripes 124. Thus, visible light is emitted from the fluorescent stripes 124. The visible light thus emitted can be seen through the first or second glass substrate 111 or 121.

One of each pair of sustain electrodes 112 and 115 is used as a common electrode and the other is used as a scan electrode. The selection electrodes 122 are used to select desired ones of the cells 105 for displaying a visible image on the PDP as necessary.

Typically, the visible light emitted from the fluorescent stripes 124 is seen through the first glass substrate 111. In this case, the pairs of sustain electrodes 112 and 115 are made of a transparent conductive material such as indium tin oxide (ITO), and the selection electrodes 122 are made of a conductive metal.

With the prior-art PDP shown in FIGS. 1A to 1C, the dielectric layer 113 of the first component 101 has an approximately uniform thickness over the whole layer 113. Therefore, if the thickness of the dielectric layer 113 is increased to improve the light-emitting efficiency, the discharge-sustaining voltage applied across the pairs of the sustain electrodes 112 and 115 needs to be raised, thereby arising a problem that the power consumption of the PDP is increased. On the other hand, if the thickness of the dielectric layer 113 is decreased to lower the discharge-sustaining voltage, a problem that the light-emitting efficiency degrades occurs.

SUMMARY OF THE INVENTION

Accordingly, an object of the present invention to provide a PDP that improves the light-emitting efficiency without raising the discharge-sustaining voltage, and a method of fabricating the PDP.

Another object of the present invention to provide a PDP that improves the light-emitting efficiency without increasing the power consumption, and a method of fabricating the PDP.

Still another object of the present invention to provide a PDP that realizes an improved display quality with low power consumption, and a method of fabricating the PDP.

The above objects together with others not specifically mentioned will become clear to those skilled in the art from the following description.

According to a first aspect of the present invention, a PDP is provided, which is comprised of a first substrate;

a second substrate coupled with the first substrate to form a specific gap between inner surfaces of the first and second substrates;

pairs of a first sustain electrode and a second sustain electrode formed on or over the inner surface of the first substrate; the pairs of first and second sustain electrodes extending in a first direction and arranged at a specific pitch in a second direction perpendicular to the first direction; each of the pairs of first and second sustain electrodes being apart from each other at a specific gap;

a first dielectric layer formed on or over the inner surface of the first substrate to cover the pairs of first and second sustain electrodes;

selection electrodes formed on or over the inner surface of the second substrate to extend in the second direction; the selection electrodes being arranged in the first direction at a specific pitch;

a second dielectric layer formed on or over the inner surface of the second substrate to cover the selection electrodes;

partition walls formed in the gap between the inner surfaces of the first and second substrates to extend in the second direction; partition walls being arranged in the second direction at a specific pitch; the partition walls forming discharge spaces in the gap;

fluorescent layers formed respectively in the discharge spaces; and a discharge gas introduced in the discharge spaces.

An overlapping part of the first dielectric layer with the first sustain electrode has a non-uniform thickness in a widthwise direction of the first sustain electrode. An overlapping part of the first dielectric layer with the second sustain electrode has a non-uniform thickness in a widthwise direction of the second sustain electrode.

With the PDP according to the first aspect of the present invention, the overlapping part of the first dielectric layer with each of the first sustain electrodes has a non-uniform thickness in the widthwise direction of the first sustain electrode, and the overlapping part of the first dielectric layer with each of the second sustain electrodes has a non-uniform thickness in the widthwise direction of the second sustain electrode. Therefore, for example, the thickness of the first dielectric layer can be decreased at a suitable part of the first sustain electrode and at a suitable part of the second sustain electrode. As a result, even if the discharge-sustaining voltage applied across each pair of the first and second sustain electrodes is lowered, the light-emitting efficiency of the PDP is improved according to the decreased thickness of the first dielectric layer. This leads to both low power consumption and good display quality.

According to a second aspect of the present invention, a method of fabricating the PDP according to the first aspect is provided, which is comprised of the following steps (a) to (c).

(a) Protrusions are formed on the inner surface of the first substrate to extend the first direction and to be arranged at a specific pitch in the second direction.

(b) The pairs of first and second sustain electrodes extending in the first direction are formed on the inner surface of first substrate to be overlapped with the protrusions.

(c) The first dielectric layer are formed on the inner surface of the first substrate to cover the pairs of first and second sustain electrodes in such a way that the overlapping part of the first dielectric layer with the first sustain electrode has a non-uniform thickness in a widthwise direction of the first sustain electrode and the overlapping part of the first dielectric layer with the second sustain electrode has a non-uniform thickness in a widthwise direction of the second sustain electrode.

With the method of fabricating a PDP according to the second aspect of the present invention, the PDP having the protrusions on the inner surface of the first substrate according to the first aspect can be obtained.

According to a third aspect of the present invention, another method of fabricating the PDP according to the first aspect is provided, which is comprised of the following steps (a') and (b').

(a') The pairs of first and second sustain electrodes extending in the first direction are formed on the inner surface of the first substrate.

(b') The first dielectric layer is formed on the inner surface of the first substrate to cover the pairs of first and second sustain electrodes. The first dielectric layer have depressions on its surface at an opposite side to the first substrate. Each of the depressions is located to be overlapped with the inner parts of the first and second sustain electrodes in each of the pairs.

With the method of fabricating a PDP according to the third aspect of the present invention, the PDP having the depressions on the opposite surface of the first dielectric layer to the first substrate according to the first aspect can be obtained.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1A:
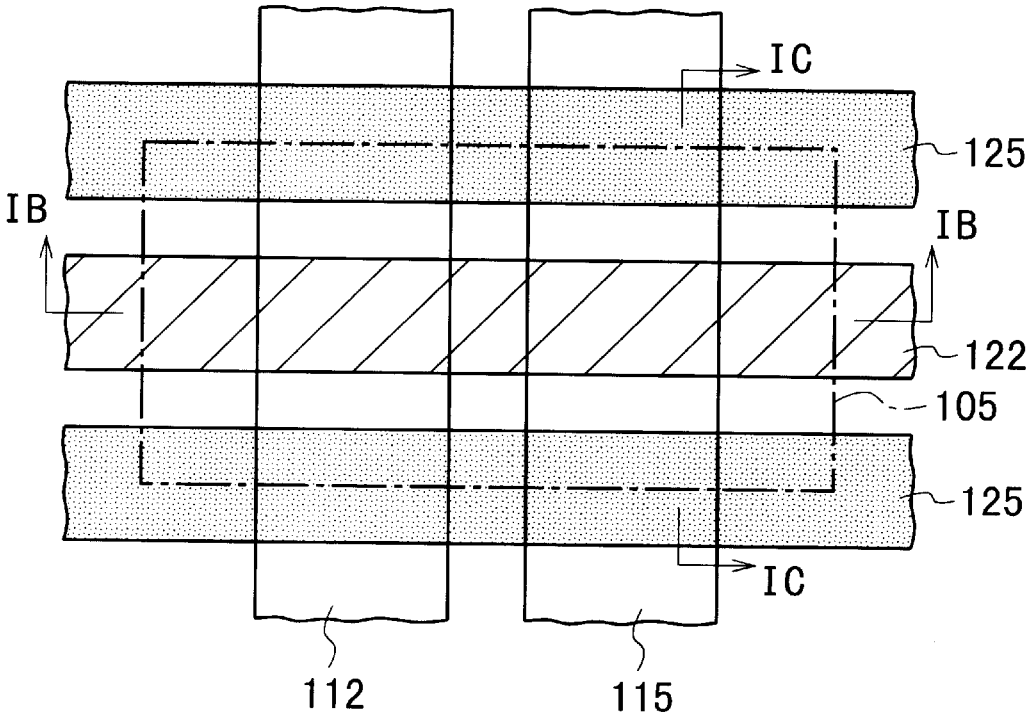
FIG. 1A PRIOR ART
FIG. 1A is a partial plan view showing the configuration of a prior-art surface-discharge type PDP.

Preferred embodiments of the present invention will be described in detail below while referring to the drawings attached.

FIRST EMBODIMENT

Figure 2:
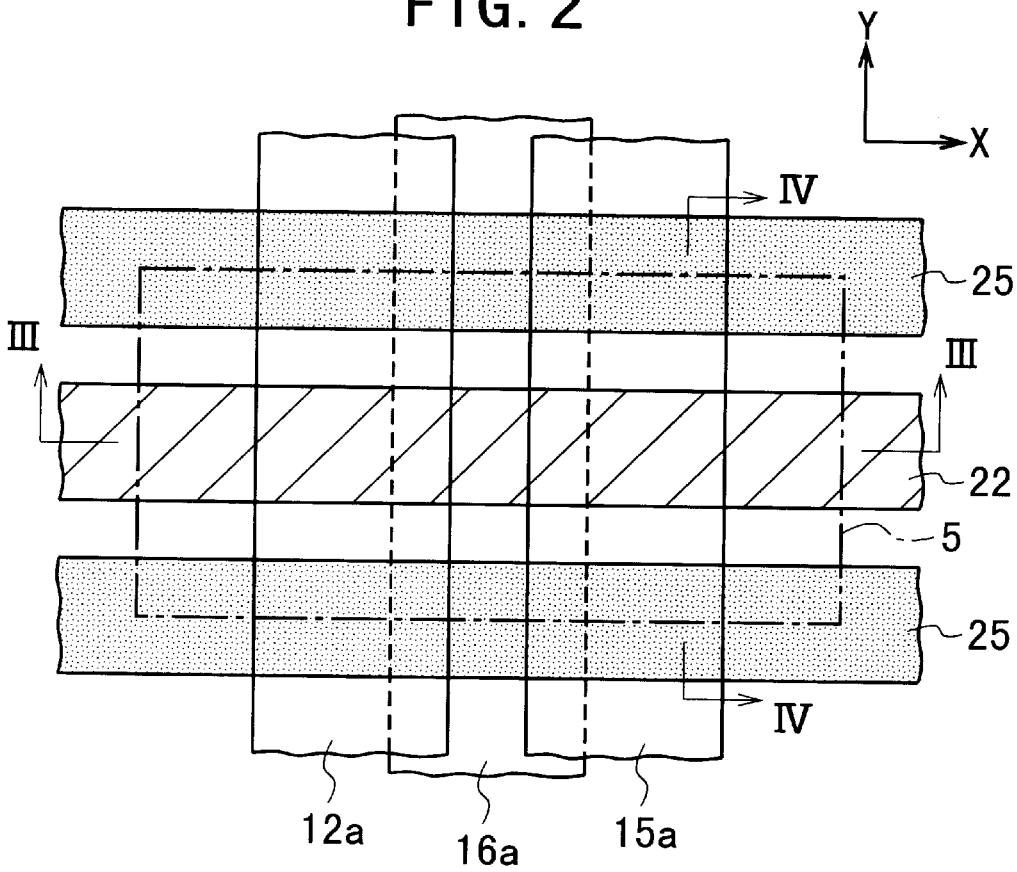
FIG. 2 is a partial plan view showing the configuration of a surface-discharge type PDP according to a first embodiment of the present invention.
Figure 3:
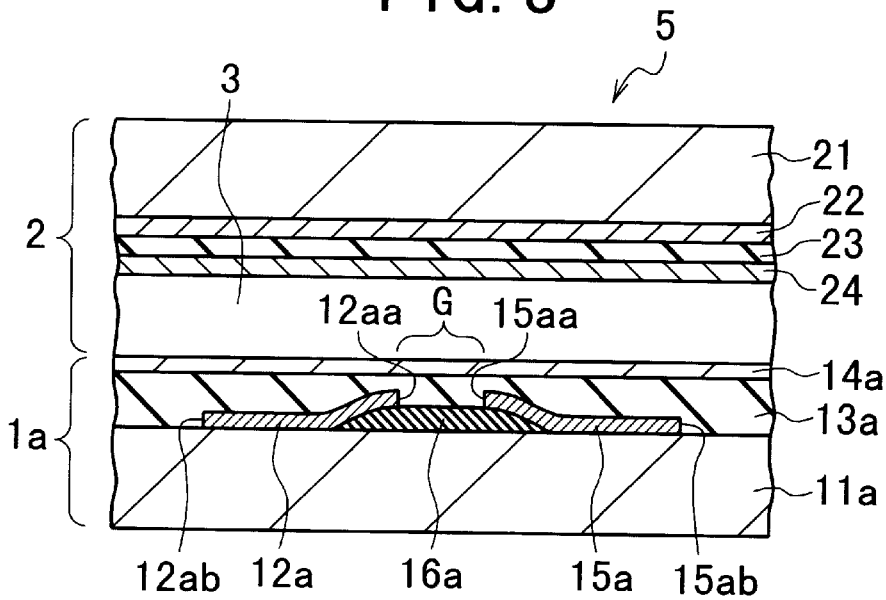
FIG. 3 is a partial cross-sectional view along the line III—III in FIG. 2.
Figure 4:
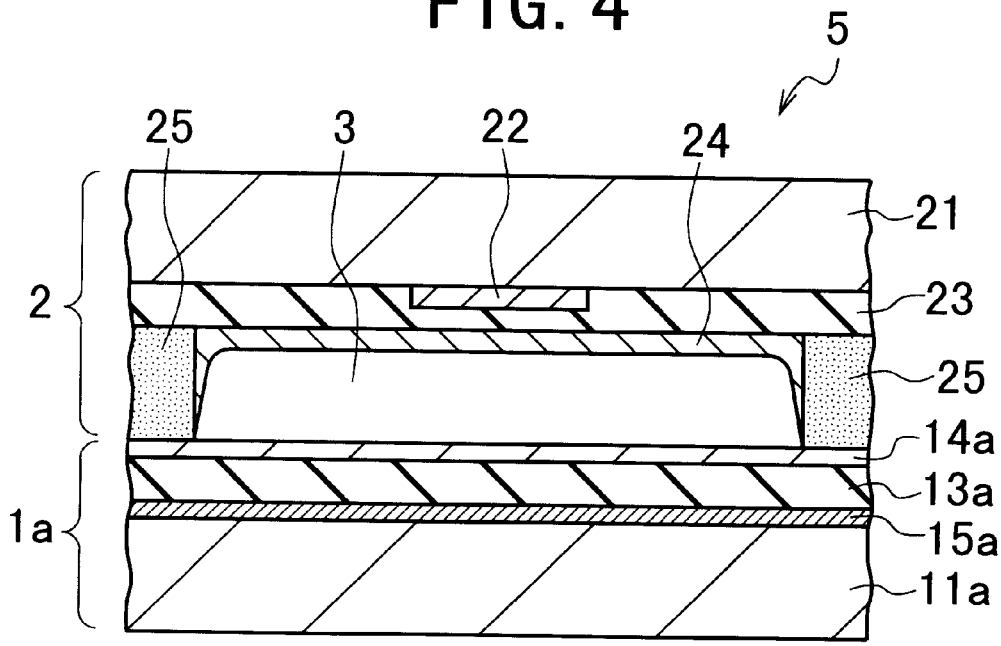
FIG. 4 is a partial cross-sectional view along the line IV—IV in FIG. 2.

As shown in FIGS. 2, 3, and 4, a surface-discharge type PDP according to a first embodiment of the present invention is comprised of first and second components 1*a* and 2 coupled together. The components 1*a* and 2 are of a plate shape.

The first component 1*a* has a first glass substrate 11*a*, elongated or strip-shaped dielectric layers 16*a* formed on the flat inner surface of the substrate 11*a*, pairs of elongated or strip-shaped sustain electrodes 12*a* and 15*a* formed on the inner surface of the substrate 11*a* to be overlapped with the corresponding dielectric layers 16*a*, a dielectric layer 13*a* formed on the inner surface of the substrate 11*a* to cover the dielectric layers 16*a* and the pairs of sustain electrodes 12*a* and 15*a*, and a Mg0 layer 14*a* formed on the dielectric layer 13*a*.

The pairs of sustain electrodes 12*a* and 15*a* extend in parallel in the Y direction, which are arranged in the X direction at a specific pitch, where the X and Y directions are perpendicular to each other, as shown in FIG. 2. The strip-shaped dielectric layers 16*a* extend in the Y direction and in parallel to the pairs of the sustain electrodes 12*a* and 15*a*. The dielectric layers 16*a* are arranged in the X direction at the same pitch as that of the pairs of the sustain electrodes 12*a* and 15*a*. Each of the dielectric layers 16*a* is located on the center line of a corresponding one of the pairs of strip-shaped sustain electrodes 12*a* and 15*a*.

Due to the existence of the strip-shaped dielectric layers 16*a*, the overlapped parts (i.e., the inner end parts) of the pairs of sustain electrodes 12*a* and 15*a* are raised or protruded and apart from the inner surface of the first glass substrate 11*a*. The reference symbols 12*aa* and 15*aa* denote the inner ends of the sustain electrodes 12*a* and 15*a*, respectively.

Figure 5:
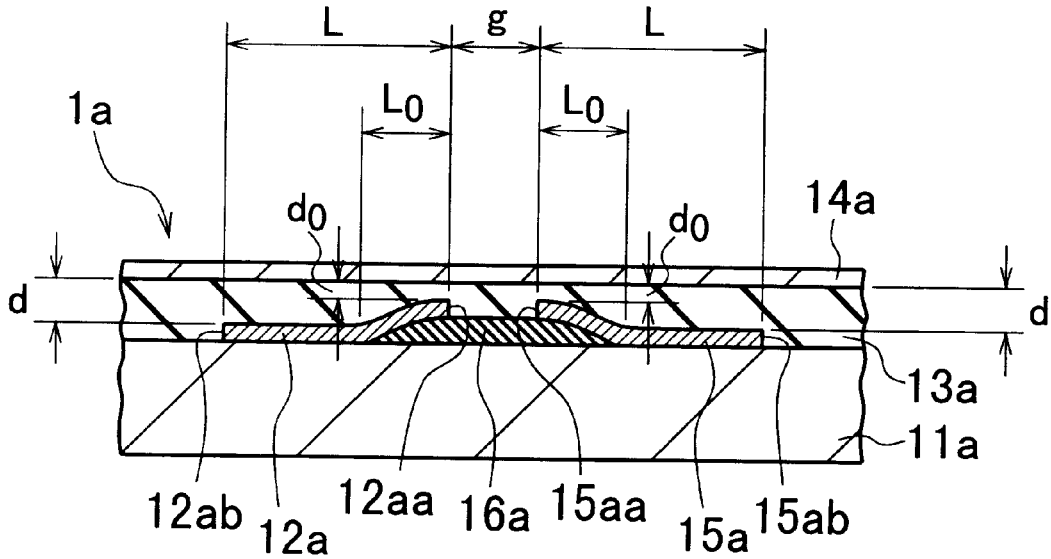
FIG. 5 is a partial cross-sectional view along the line III—III in FIG. 2, which explains the dimensions of various parts of the surface-discharge type PDP according to the first embodiment of FIG. 3.

As shown in FIG. 5, each of the sustain electrodes 12*a* is apart from a corresponding one of the sustain electrodes 15*a* by a specific constant distance, i.e., a discharge gap g. The sustain electrodes 12*a* and 15*a* have a same width of L. The overlapped parts (i.e., the inner end parts) of the electrodes 12*a* and 15*a* with the corresponding dielectric layers 16*a* have a same width of $L_0$, where $L_0$<L.

The dielectric layer 13*a* covering the sustain electrodes 12*a* and 15*a*, which is made of low melting-point glass, has an approximately flat surface at its opposite side to the first glass substrate 11*a*. Because of the partially-raised sustain electrodes 12*a* and 15*a*, the thickness of the dielectric layer 13*a* is not uniform in the direction X (i.e., the widthwise direction of the electrodes 12*a* and 15*a*). As shown in FIG. 5, the non-overlapped parts of the dielectric layer 13*a* with the dielectric layers 16*a* have an original thickness of d. However, the overlapped parts of the dielectric layer 13*a* with the dielectric layers 16*a* have a smaller thickness than d. At the inner ends 12*aa* and 15*aa* of the sustain electrodes 12*a* and 15*a*, the dielectric layer 13*a* has a minimum thickness of $d_0$, where $d_{0<d}$.

The dielectric layer 13*a* is contacted with the dielectric layers 16*a* through the gaps G between the sustain electrodes 12*a* and 15*a*. Therefore, the parts of the dielectric layer 13*a* located over the gaps G (i.e., the overlapped parts of the dielectric layer 13*a* with the gaps G) have a thickness larger than $d_0$.

The Mg0 layer 14*a* is used to protect the dielectric layer 13*a*. Instead of Mg0, an oxide of any alkaline earth metal may be used for the layer 14*a*.

On the other hand, the second component 2 has a second glass substrate 21, elongated or strip-shaped selection electrodes 22 formed on the inner surface of the substrate 21, a dielectric layer 23 formed on the inner surface of the substrate 21 to cover the selection electrodes 22, elongated partition walls 25 formed on the dielectric layer 23 to extend in parallel to the selection electrodes 22, and fluorescent strips 24 formed on the dielectric layer 23. The selection electrodes 22, which are perpendicular to the pairs of strip-shaped sustain electrodes 12 and 15, are arranged at a specific pitch. The partition walls 25 protrude vertically from the surface of the dielectric layer 23 and contacted with the Mg0 layer 14 of the first component 1*a*, resulting in strip-shaped discharge spaces 3 extending along the walls 25 between the first and second components 1*a* and 2. The fluorescent strips 24 cover not only the exposed surface of the dielectric layer 23 but also the side faces of the partition walls 25, as shown in FIG. 4.

The first and second components 1*a* and 2 are coupled together so that the Mg0 layer 14 is opposed to the dielectric layer 23 at a specific distance. A discharge gas (not shown) such as a xenon (Xe), krypton (Kr), argon (Ar), or nitrogen ($N_2$) gas is filled into the discharge spaces 3 to emit UV light for the purpose of exciting the fluorescent stripes 24. As shown in FIG. 2, areas (approximately rectangular in shape) near the intersections of the pair of sustain electrodes 12*a* and 15*a* and the selection electrodes 22 form unit light-emitting areas, i.e., cells 5.

On operation of the PDP according to the first embodiment of FIGS. 2 to 4, a specific voltage is applied across the pairs of sustain electrodes 12*a* and 15*a* to thereby generate and sustain electric discharge in the gas filled in the discharge spaces 3. Due to this electric discharge, UV light is emitted from the gas and irradiated to the fluorescent stripes 24. Thus, visible light is emitted from the fluorescent stripes 24.

One of each pair of sustain electrodes 12*a* and 15*a* is used as a common electrode and the other is used as a scan electrode. The selection electrodes 22 are used to select desired ones of the cells 5 for emitting visible light therefrom as necessary.

Figure 1B:
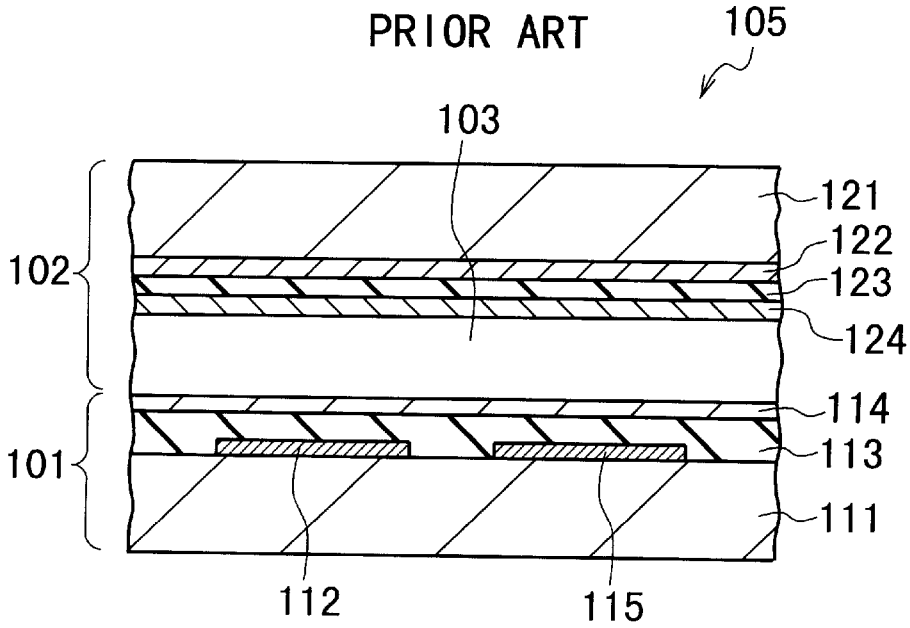
FIG. 1B PRIOR ART
FIG. 1B is a partial cross-sectional view along the line IB—IB in FIG. 1A.
Figure 1C:
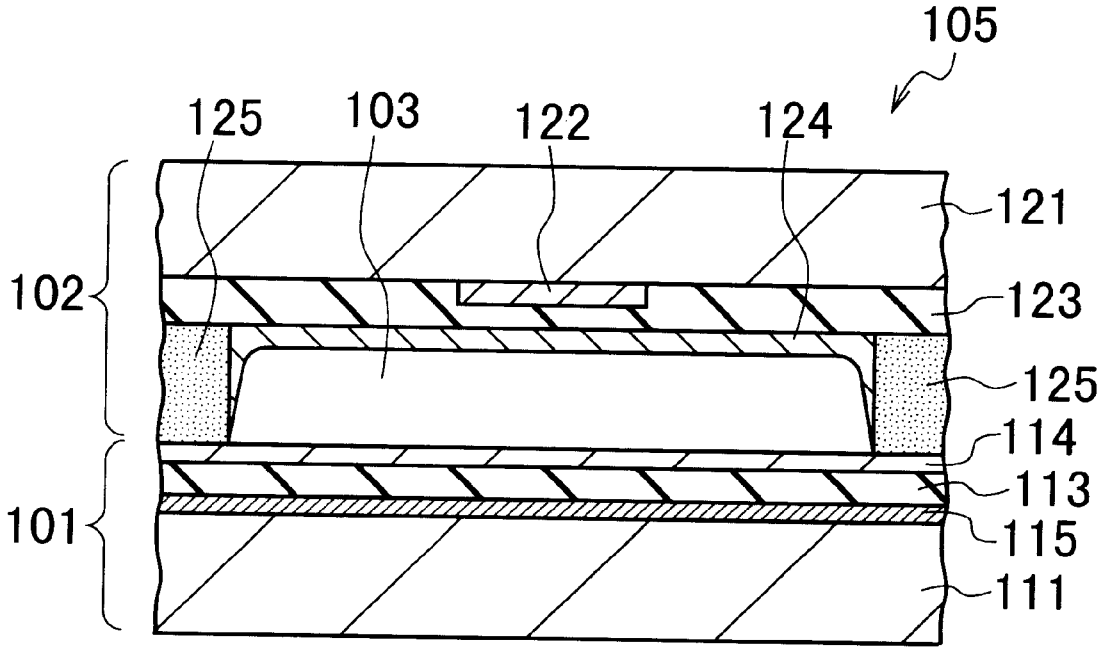
FIG. 1C PRIOR ART
FIG. 1C is a partial cross-sectional view along the line IC—IC in FIG. 1A.

The second component 2 has the same configuration as that of the second component 102 of the prior-art PDP shown in FIGS. 1A to 1C.

With the PDP according to the first embodiment of FIGS. 2 to 4, the overlapping parts of the dielectric layer 13*a* with the dielectric layers 16*a* have a thickness smaller than its original thickness d and have the minimum thickness $d_0$ at the inner ends 12*aa* and 15*aa* of the electrodes 12*a* and 15*a* in the widthwise direction of the electrodes 12*a*. Therefore, the discharge current density (which affects largely the facility of the surface discharge generated across the pairs of sustain electrodes 12*a* and 15*a*) can be decreased compared with the above-described prior-art PDP, improving the light-emitting efficiency. At the same time, the electric-field strength in the vicinity of the electrodes 12*a* and 15*a* in the discharge spaces 3 can be kept approximately unchanged.

As a result, the light-emitting efficiency of the PDP can be improved without raising the discharge-sustaining voltage applied across each pair of sustain electrodes 12*a* and 15*a*. In other words, the light-emitting efficiency of the PDP can be improved without increasing the power consumption. The improvement of the light-emitting efficiency leads to good display quality and therefore, the improved display quantity can be realized with low power consumption.

The above advantages of the PDP according to the first embodiment are derived from the inventors' knowledge described below.

First, if the thickness of the dielectric layer 13*a* is increased at its overlapping parts with the sustain electrodes 12*a* and 15*a*, the discharge current density is limited by the layer 13*a* and therefore, the light-emitting efficiency of the PDP is improved.

Second, if the thickness of the dielectric layer 13*a* is increased, the discharge-sustaining voltage applied across the electrodes 12*a* and 15*a* needs to be raised, which enhances the difficulty to drive the PDP.

Third, if the discharge gas contains a noble or inert gas such as helium (He) or neon (Ne) as its main gradient, the light-emitting efficiency of the PDP is improved as the ratio of the constituent emitting UV light is increased.

Fourth, if the discharge gas contains a noble or inert gas such as He or Ne as its main gradient, the discharge or sustain voltage is raised as the ratio of the constituent emitting UV light is increased, which makes if difficult to drive the PDP.

Fifth, if a strong electric-field is generated in the space 3 in the vicinity of the inner ends 12*aa* and 15*aa* of the sustain electrodes 12*a* and 15*a*, the discharge-sustaining voltage can be lowered to a practical range. This is possible even if the original thickness d of the dielectric layer 13*a* is large, and/or the ratio of the constituent emitting UV light in the discharge gas is high.

Next, a method of fabricating the PDP according to the first embodiment of FIGS. 2 to 4 is explained below with reference to FIGS. 6A to 6K.

The first plate-shaped component 1*a* is fabricated in the following way.

Figure 6A:
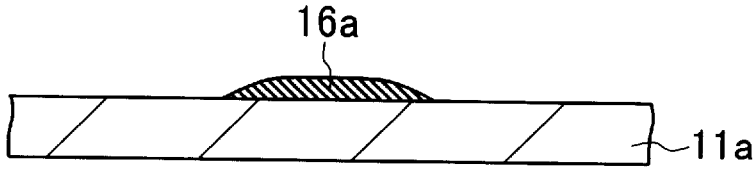
FIGS. 6A to 6K are partial cross-sectional views along the line III—III in FIG. 2, respectively, which show a method of fabricating the first substrate of the surface-discharge type PDP according to the first embodiment of FIG. 3.

First, a dielectric paste containing a low-melting point glass as its main constituent is applied or coated on the specific desired locations on the inner surface of the glass substrate 11*a* by a screen printing process, forming a patterned dielectric paste layer. Next, the patterned dielectric paste layer is sintered, thereby forming the strip-shaped dielectric layers 16*a* on the inner surface of the substrate 11*a*, as shown in FIG. 6A. The dielectric layers 16*a* extend in the Y direction and are arranged in the X direction at the specific pitch. The location of the layers 16*a* are determined so that the pairs of sustain electrodes 12*a* and 15*a* are overlapped with the corresponding layers 16*a*, as shown in FIGS. 2 and 3.

Instead, the strip-shaped dielectric layers 16*a* may be formed on the surface of the substrate 11*a* in any one of the following processes (i) to (iv).

(i) A dielectric paste containing a low-melting point glass as its main constituent is applied or coated on the whole inner surface of the glass substrate 11*a*, forming a dielectric paste layer. Then, the dielectric paste layer is patterned by etching and sintered, thereby forming the strip-shaped dielectric layers 16*a* on the surface of the substrate 11*a*, as shown in FIG. 6A.

(ii) A dielectric paste containing a low-melting point glass as its main constituent is applied or coated on the whole inner surface of the glass substrate 11*a*, forming a dielectric paste layer. Then, a photosensitive resin layer is formed on the dielectric past layer and patterned. Using the patterned photosensitive resin layer as a mask, the dielectric paste layer is patterned by sand-blasting. After the patterned photosensitive resin layer is removed, the patterned dielectric paste layer is sintered, resulting in the strip-shaped dielectric layers 16*a* on the surface of the substrate 11*a*, as shown in FIG. 6A.

(iii) A photosensitive resin layer is formed on the whole inner surface of the glass substrate 11*a* and then, it is patterned to form openings therein as a negative of the strip-shaped dielectric layers 16*a*. Next, a dielectric paste is filled into the openings thus formed, forming a patterned dielectric paste layer. Subsequently, the patterned photosensitive resin layer is removed and the patterned dielectric paste layer is sintered, resulting in the strip-shaped dielectric layers 16*a* on the surface of the substrate 11*a*, as shown in FIG. 6A.

(iv) A photosensitive dielectric paste is applied to the whole inner surface of the glass substrate 11*a* and then, it is patterned by using suitable light to form the strip-shaped dielectric layers 16*a* on the surface of the substrate 11*a*, as shown in FIG. 6A.

The low-melting point glass contained in the dielectric paste as its main constituent has a higher softening-point than that of a similar low melting-point glass paste for the dielectric layer 13*a*. Thus, the strip shape of the dielectric layers 16*a* can be kept unchanged during the subsequent process of forming the dielectric layer 13*a*. It is preferred in driving the PDP that the relative dielectric constant of the dielectric layers 16*a* is lower than that of the dielectric layer 13*a*.

Figure 6B:
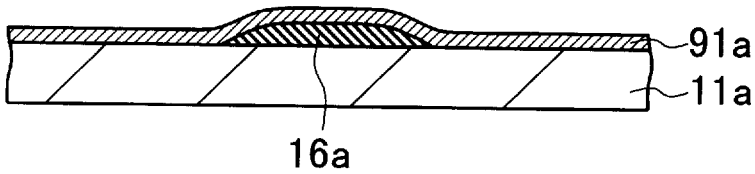

Following the above-described step of forming the strip-shaped dielectric layers 16*a*, a transparent conductive layer 91*a* is formed on the whole surface of the glass substrate 11*a* to cover the strip-shaped dielectric layers 16*a*, as shown in FIG. 6B. The layer 91*b* can be formed by a popular process such as sputtering, CVD, or vacuum evaporation.

Figure 6C:
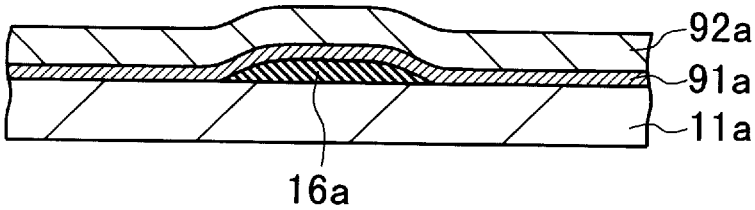
Figure 6D:
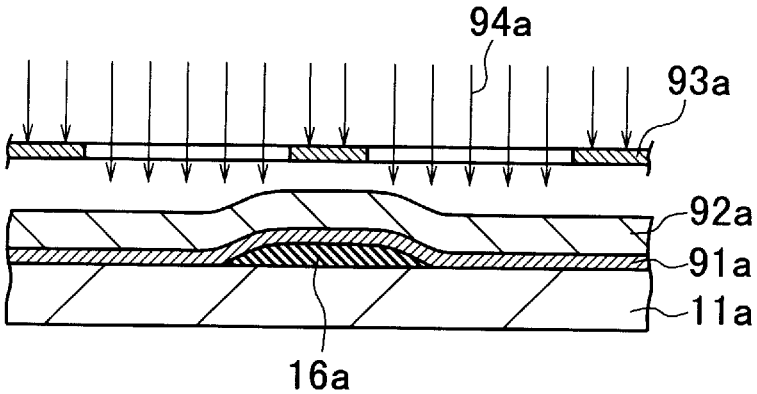
Figure 6E:
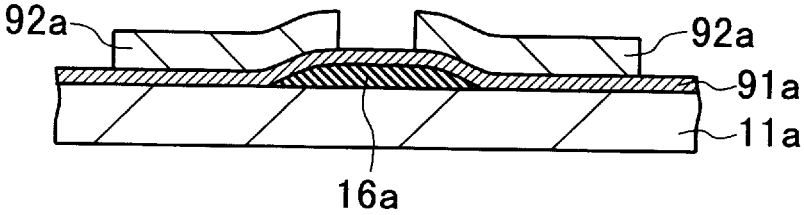

A photosensitive resin layer 92*a* is formed on the whole surface of the transparent conductive layer 91*a*, as shown in FIG. 6C. Then, as shown in FIG. 6D, UV light 94*a* is selectively irradiated to the photosensitive resin layer 92*a* through a mask 93*a*. The mask 93*a* has windows shaped to form the sustain electrodes 12*a* and 15*a*. The unexposed part of the layer 92*a* to the UV light 94*a* is then removed by development, exposing the underlying transparent conductive layer 91*a* through the windows of the mask 93*a*, as shown in FIG. 6E. Thus, the photosensitive resin layer 92*a* is patterned.

Figure 6F:
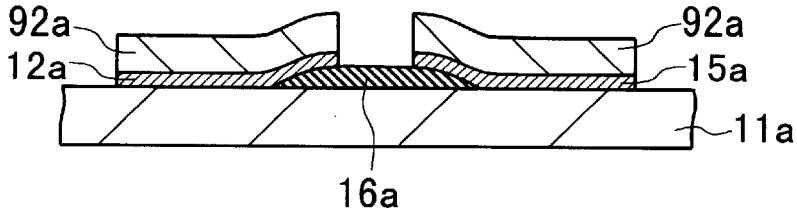
Figure 6G:
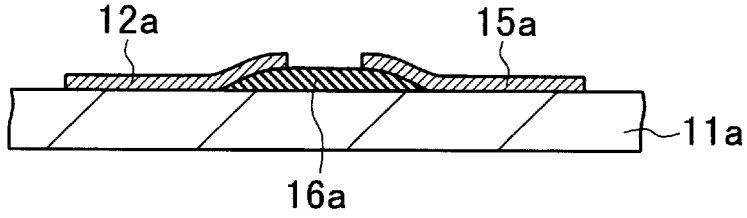

Using the patterned photosensitive resin layer 92*a* as a mask, the exposed part of the transparent conductive layer 91*a* is selectively removed by etching to thereby form the pairs of sustain electrodes 12*a* and 15*a* on the inner surface of the first glass substrate 11*a*, as shown in FIG. 6F. The remaining, exposed part of the layer 92*a* to the UV light 94*a* is then removed. Thus, as shown in FIG. 6G, the pairs of strip-shaped sustain electrodes 12*a* and 15*a* are formed so as to overlap with the strips-shaped dielectric layer 16*a*.

If the PDP is used for large-sized displays, the electric resistance of the sustain electrodes 12*a*and 15*a* may be high. In this case, to decrease the electric resistance, trace electrodes (not shown) may be additionally formed at a location apart from the electrodes 12*a* and 15*a*.The trace electrodes are electrically connected to the sustain electrodes 12*a* and 15*a*.

Figure 6H:
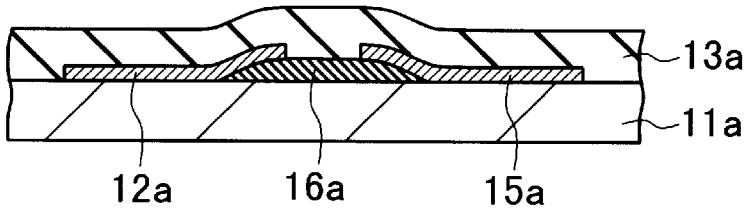

Subsequently, a dielectric paste containing a low melting-point glass as its main ingredient is applied to the inner surface of the substrate 11*a* and the dielectric layers 16*a* by screen printing to thereby form a dielectric paste film. Then, the dielectric paste film thus formed is sintered, resulting in the dielectric layer 13*a* formed on the surface of the substrate 11*a* to cover the sustain electrodes 12*a* and 15*a* and the dielectric layers 16*a*. As shown in FIG. 6H, the dielectric layer 13*a* thus formed is partially raised or expanded upward according to the electrodes 12*a* and 15*a* and the dielectric layers 16*a*.

Figure 6I:
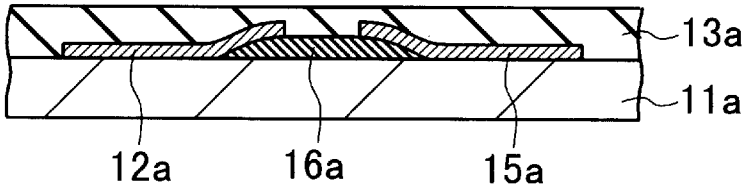

The surface of the dielectric layer 13*a* is then polished for planarization, which may be performed by a popular mechanical polishing process. As a result, the surface of the dielectric layer 13*a* becomes approximately flat, which means that the overlapped part of the layer 13*a* with the electrodes 12*a* and 15*a* or the dielectric layers 16*a* has a smaller thickness than the original thickness d of the remaining, non-overlapped part thereof, as shown in FIG. 6I.

The dielectric layer 13*a* whose surface is approximately flat may be formed in the following way. Specifically, a dielectric paste containing a low melting-point glass as its main ingredient is applied to the inner surface of the substrate 11*a* by screen printing, thereby forming a dielectric paste layer with a flat surface. This can be performed by using a blade coater or the like. Next, the dielectric paste layer is sintered.

Figure 6J:
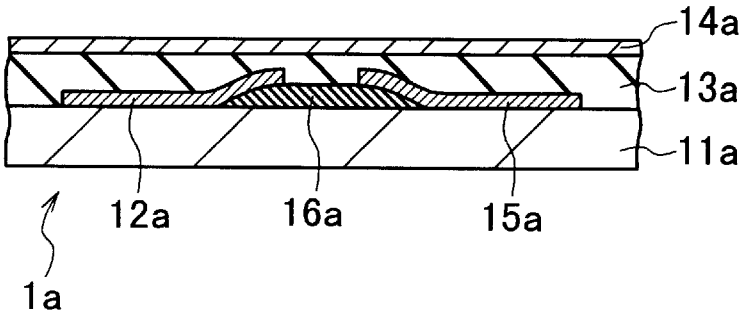

Finally, the Mg0 layer 14*a* is formed on the dielectric layer 13*a*, resulting in the first component 1*a*, as shown in FIG. 6J. The layer 14*a* may be formed by vacuum evaporation or sputtering.

On the other hand, the second component 2 is fabricated in a popular method (not shown). For example, first, the strip-shaped selection electrodes 22 are formed on the flat inner surface of the glass substrate 21 to be perpendicular to the sustain electrodes 12*a* and 15*a*. The electrodes 22 may be formed by a metal such as Ag, Al, Cr, and Cu.

Next, the dielectric layer 23 is formed to cover the selection electrodes 22 over the whole substrate 21. The partition walls 25 are formed on the dielectric layer 23 thus formed to extend in the X direction. The walls 25 may be formed by low-melting point glass containing a suitable filler. A fluorescent paste is selectively applied to the exposed surface of the dielectric layer 23 and the side faces of the walls 25, forming fluorescent paste layers. Then, the fluorescent paste layers are sintered, resulting in the fluorescent layers 24. Thus, the second component 2 is fabricated.

Figure 6K:
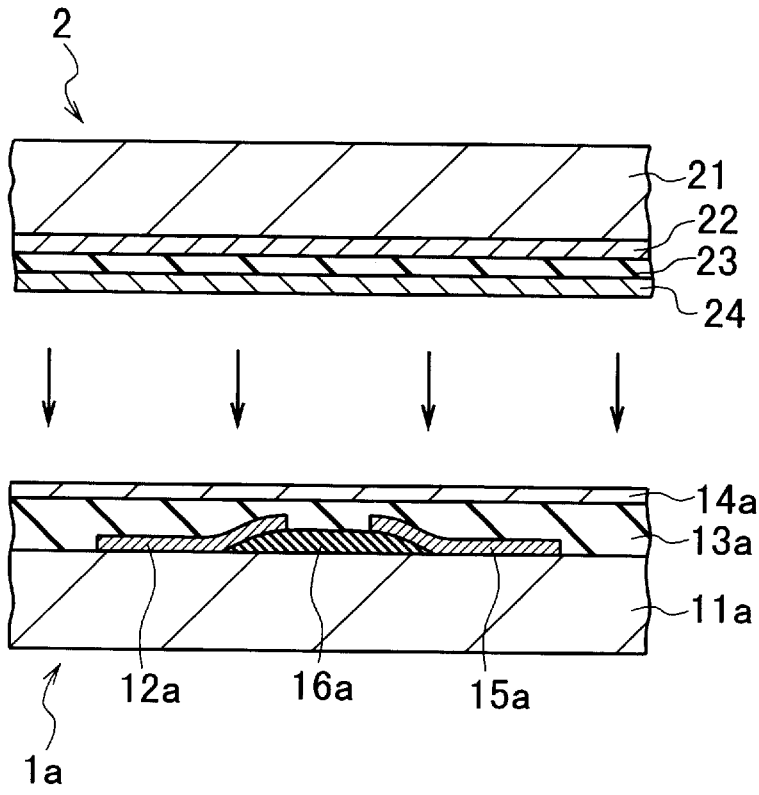

The first and second plate-shaped components 1*a* and 2 are bonded or coupled together so that the partition walls 25 are contacted with the opposing Mg0 layer 14*a*, as shown in FIG. 6K. At this stage, the discharge spaces 3 are formed by the walls 25 and the dielectric and Mg0 layers 14*a* and 13. The gas existing in the spaces 3 are then evacuated by, for example, placing the coupled components 1*a* and 2*a* in a suitable vacuum chamber. Thereafter, the discharge gas containing an inert gas such as Xe is charged into the spaces 3, resulting in the PDP according to the first embodiment shown in FIGS. 2, 3, and 4.

The first component 1*a* may be fabricated in another method as shown in FIGS. 7A to 7G, in which the formation process of the sustain electrodes 12*a* and 15*a* is different from that of the above-described method shown in FIGS. 6A to 6K.

Figure 7A:
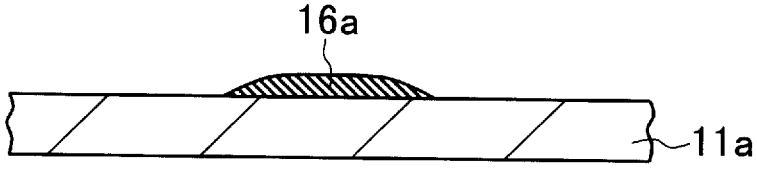
FIGS. 7A to 7G are partial cross-sectional views along the line III—III in FIG. 2, respectively, which show another method of fabricating the first substrate of the surface-discharge type PDP according to the first embodiment of FIG. 3.

Specifically, first, a dielectric paste containing a low-melting point glass as its main constituent is applied or coated on the specific locations of the flat inner surface of the glass substrate 11*a* by a screen printing process, forming a patterned dielectric paste layer. Next, the patterned dielectric paste layer is sintered, thereby forming the strip-shaped dielectric layers 16*a* on the surface of the substrate 11*a*, as shown in FIG. 7A.

Figure 7B:
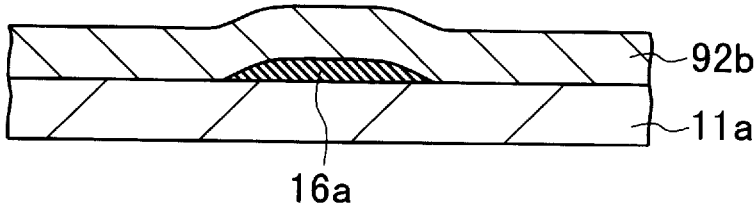
Figure 7C:
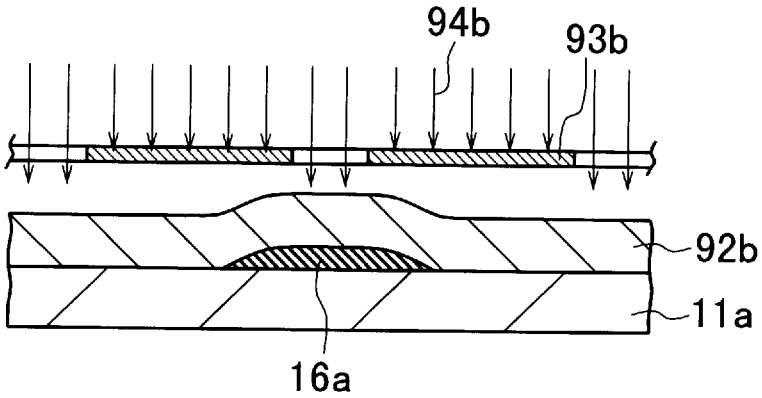
Figure 7D:
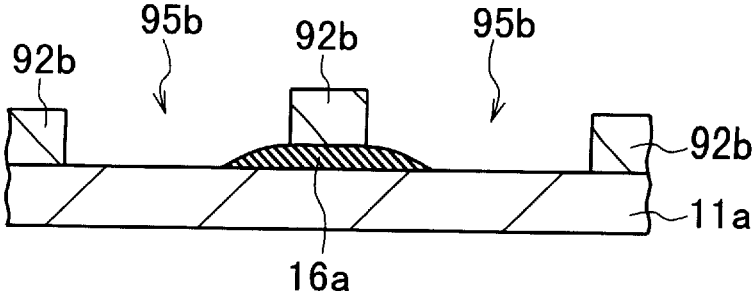

Next, a photosensitive resin layer 92*b* is formed on the whole surface of the glass substrate 11*a* to cover the strip-shaped dielectric layers 16*a*, as shown in FIG. 7B. Then, as shown in FIG. 7C, UV light 94*b* is selectively irradiated to the photosensitive resin layer 92*b* through a mask 93*b*. The mask 93*b* has windows shaped to form the sustain electrodes 12*a* and 15*a*. The unexposed part of the layer 92*b* to the UV light 94*b* is then removed by development, exposing the underlying photosensitive resin layer 92*b* and the glass substrate 11*a* through the windows 95*b* of the layer 92*b*, as shown in FIG. 7D.

Figure 7E:
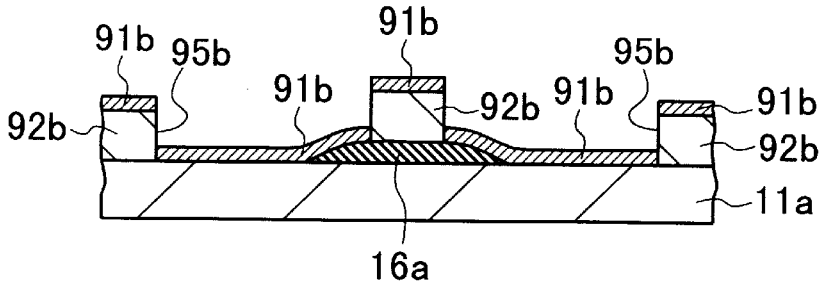

Subsequently, as shown in FIG. 7E, a transparent conductive layer 91*b* is deposited over the whole substrate 11*a* by a popular process such as sputtering, CVD, or vacuum evaporation. The layer 91*b* thus deposited is contacted with not only the remaining photosensitive resin layer 92*b* but also the glass substrate 11*a* a d the dielectric layer 16*a* through the windows 95*b* of the photosensitive resin layer 92*b*.

Figure 7F:
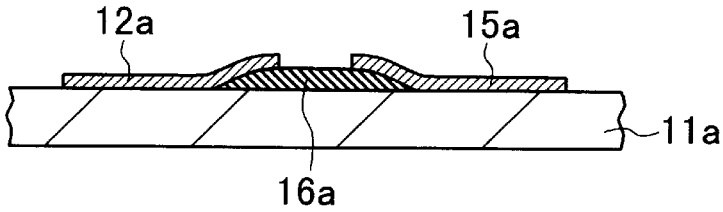

The photosensitive resin layer 92*b* is then removed to thereby leave selectively the part of the transparent conductive layer 91*b* existing in the windows 95*b*. The part of the layer 91*b* thus left forms the strip-shaped sustain electrodes 12*a* and 15*a*, as shown in FIG. 7F.

As described here, the well-known lift-off method is used to form the sustain electrodes 12*a* and 15*a*.

Subsequently, a dielectric paste containing a low melting-point glass as its main ingredient is applied to the surface of the substrate 11*a* by screen printing to thereby form a dielectric paste film and then, the dielectric paste film is sintered, resulting a dielectric layer 13*a* formed on the surface of the substrate 11*a* to cover the sustain electrodes 12*a* and 15*a* and the dielectric layers 16*a*. Not shown here, the dielectric layer 13*a* thus formed is partially raised or expanded upward according to the sustain electrodes 12*a* and 15*a* and the dielectric layers 16*a*.

The surface of the dielectric layer 13*a* is then polished for planarization. As a result, the surface of the dielectric layer 13*a* becomes approximately flat, which means that the overlapped part of the layer 13*a* with the electrodes 12*a* and 15*a* has a smaller thickness than the original thickness d of the remaining, non-overlapped part, as shown in FIG. 7G.

Figure 7G:
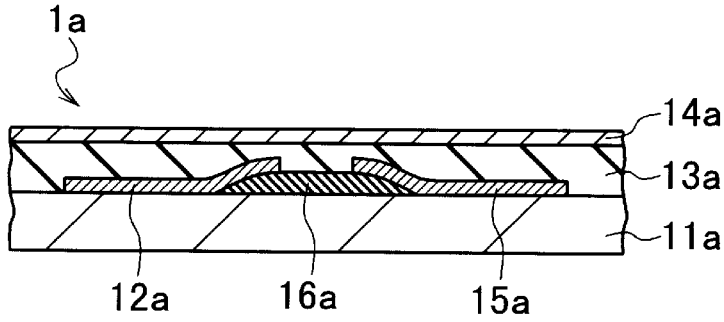

Finally, the Mg0 layer 14*a* is formed on the dielectric layer 13*a* with the surface being flat, resulting in the first component 1*a*, as shown in FIG. 7G.

SECOND EMBODIMENT

Figure 8:
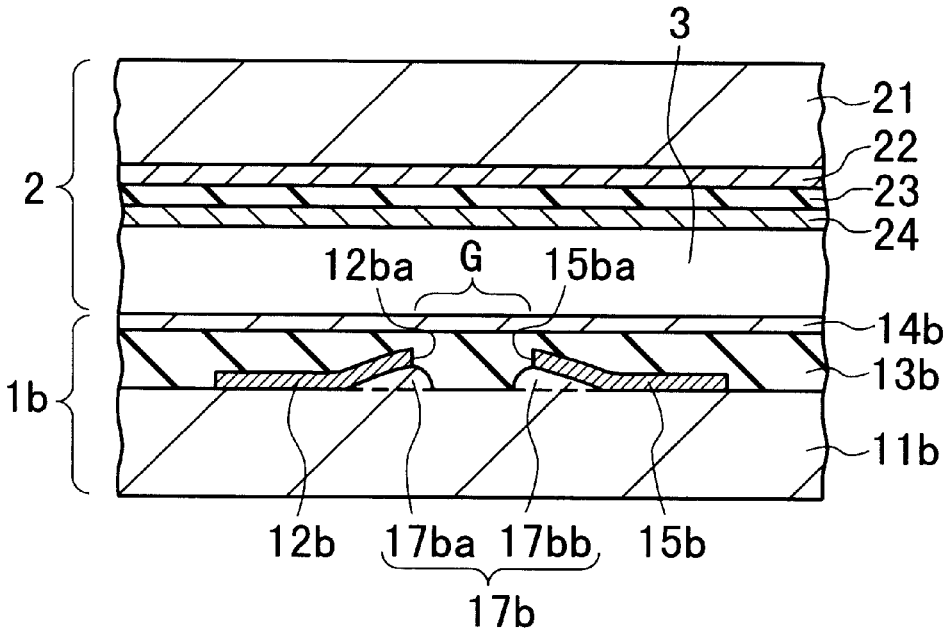
FIG. 8 is a partial plan view showing the configuration of a surface-discharge type PDP according to a second embodiment of the present invention, which is a first variation of the first embodiment of FIG. 3.

FIG. 8 shows a surface-discharge type PDP according to a second embodiment of the present invention, which has the same configuration as that of the PDP according to the first embodiment of FIGS. 2 to 4 except that a first component 1*b* is used instead of the first component 1*a*. Therefore, the explanation about the same configuration is omitted here for the sake of simplification by attaching the same reference symbols as those in FIG. 3 to the same elements in FIG. 8.

In the first component 1*b*, the flat inner surface of a glass substrate 11*b* has pairs of strip-shaped protrusions 17*ba* and 17*bb* extending along the Y direction instead of the strip-shaped dielectric layers 16*a*. Each of the protrusions 17*ba* is apart from a corresponding one of the protrusions 17*bb* by a specific distance. The pairs of protrusions 17*ba* and 17*bb* serve to raise the inner ends 12*ba* and 15*ba* and their vicinity of pairs of strip-shaped sustain electrodes 12*b* and 15*b*, as shown in FIG. 8. Therefore, each pair 17*b* of the protrusions 17*ba* and 17*bb* has the same function as that of each strip-shaped dielectric layer 16*a* in the first embodiment.

A dielectric layer 13*b*, which is made of low melting-point glass, has an approximately flat surface. The thickness of the dielectric layer 13*b* is not constant in the direction X (i.e., the widthwise direction of the sustain electrodes 12*b* and 15*b*). The non-overlapped parts of the layer 13*b* with the protrusion pairs 17*b* have a thickness of d. The overlapped parts of the layer 13*b* with the protrusion pairs 17*b* have a thickness less than d. At the inner ends 12*ba* and 15*ba* of the sustain electrodes 12*b* and 15*b*, the dielectric layer 13*b* have a minimum thickness $d_0$.

A Mg0 layer 14*b* is formed on the flat surface of the dielectric layer 13*b*.

The glass substrate 11*b* having the protrusion pairs 17 can be fabricated by, for example, selectively etching the flat inner surface of the glass substrate 11*b* and by mechanically polishing the etched surface.

It is needless to say the PDP according to the second embodiment has the same advantages as those in the first embodiment

THIRD EMBODIMENT

Figure 9:
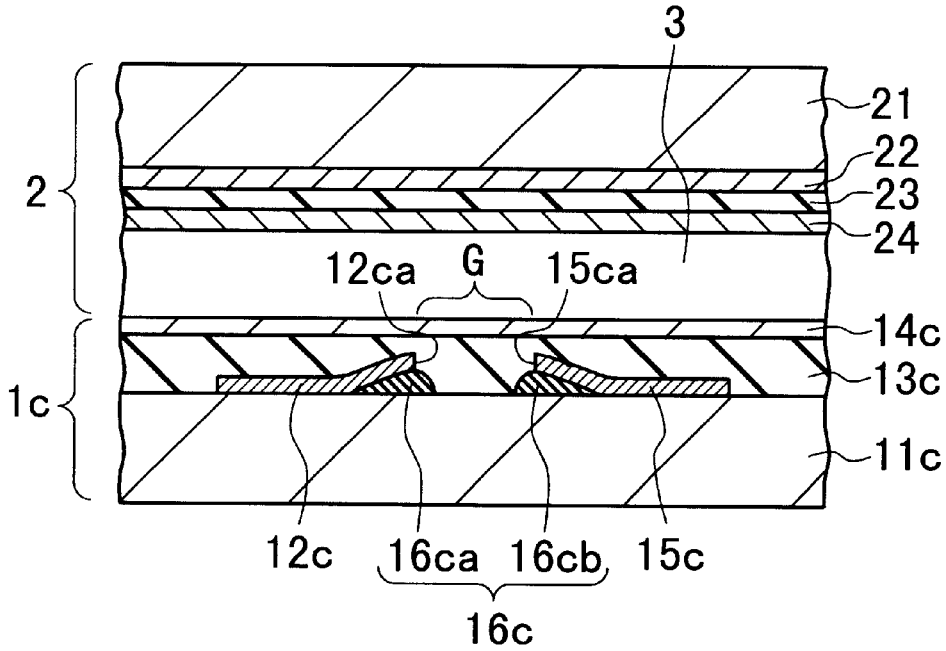
FIG. 9 is a partial plan view showing the configuration of a surface-discharge type PDP according to a third embodiment of the present invention, which is a second variation of the first embodiment of FIG. 3.

FIG. 9 shows a surface-discharge type PDP according to a third embodiment of the present invention, which has the same configuration as that of the PDP according to the first embodiment of FIGS. 2 to 4 except that a first component 1*c* is used instead of the first component 1*a*. Therefore, the explanation about the same configuration is omitted here for the sake of simplification by attaching the same reference symbols as those in FIG. 3 to the same elements in FIG. 9.

In the first component 1*c*, strip-shaped dielectric layers 16*ca* and 16*cb* extending along the Y direction are formed on the flat inner surface of a glass substrate 11*c* instead of the strip-shaped dielectric layers 16*a*. The layers 16*ca* and 16*cb* are apart from each other by a specific distance. Each pair 16*c* of the dielectric layers 16*ca* and 16*cb* serve to raise the inner ends 12*ca* and 15*ca* and their vicinity of strip-shaped sustain electrodes 12*c* and 15*c*, as shown in FIG. 9.

A dielectric layer 13*c*, which is made of low melting-point glass, has an approximately flat surface. The thickness of the dielectric layer 13*c* is not constant in the direction X. The non-overlapped parts of the layer 13*c* with the pairs 16*c* of the dielectric layers 16*ca* and 16*cb* have a thickness of d. The overlapped parts of the layer 13*c* with the pairs 16*c* have a thickness less than d. At the inner ends 12*ca* and 15*ca* of the sustain electrodes 12*c* and 15*c*, the dielectric layer 13*c* have a minimum thickness $d_0$.

A Mg0 layer 14*c* is formed on the flat surface of the dielectric layer 13*c*.

The dielectric layers 16*ca* and 16*cb* can be fabricated in the same way as shown in the first embodiment.

It is needless to say the PDP according to the third embodiment has the same advantages as those in the first embodiment. Compared with the first embodiment, there is an additional advantage that the inner surface of the glass substrate 11*b* is difficult to be degraded, because the surface of the substrate 11*c* is exposed between the sustain electrodes 16*ca* and 16*cb* in the gap G.

FOURTH EMBODIMENT

Figure 10:
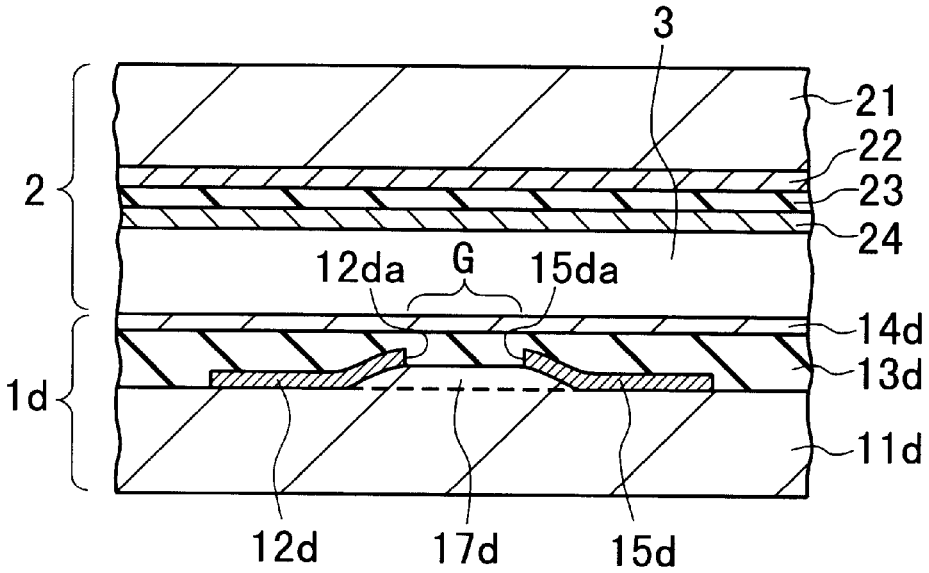
FIG. 10 is a partial plan view showing the configuration of a surface-discharge type PDP according to a fourth embodiment of the present invention, which is a third variation of the first embodiment of FIG. 3.

FIG. 10 shows a surface-discharge type PDP according to a fourth embodiment of the present invention, which has the same configuration as that of the PDP according to the first embodiment of FIGS. 2 to 4 except that a first component 1*d* is used instead of the first component 1*a*. Therefore, the explanation about the same configuration is omitted here for the sake of simplification by attaching the same reference symbols as those in FIG. 3 to the same elements in FIG. 10.

In the first component 1*d*, the inner flat surface of a glass substrate 11*d* has strip-shaped protrusions 17*d* extending in the Y direction instead of the strip-shaped dielectric layers 16*a*. The protrusions 17*d* of the glass substrate 11*d* serve to raise the inner ends 12*da* and 15*da* and their vicinity of strip-shaped sustain electrodes 12*d* and 15*d*, as shown in FIG. 10.

A dielectric layer 13*d*, which is made of low melting-point glass, has an approximately flat surface. The thickness of the dielectric layer 13*d* is not constant in the direction X. The non-overlapped parts of the layer 13*d* with the protrusions 17*d* have a thickness of d. The overlapped parts of the layer 13*d* with the protrusions 17*d* have a thickness less than d. At the inner ends 12*da* and 15*da* of the sustain electrodes 12*d* and 15*d*, the dielectric layer 13*d* have a minimum thickness $d_0$.

A Mg0 layer 14*d* is formed on the flat surface of the dielectric layer 13*d*.

The glass substrate 11*d* having the protrusion pairs 17*d* can be fabricated by, for example, selectively etching the flat surface of the substrate 11*d* and by mechanically polishing the etched surface.

It is needless to say the PDP according to the fourth embodiment has the same advantages as those in the first embodiment.

FIFTH EMBODIMENT

Figure 11:
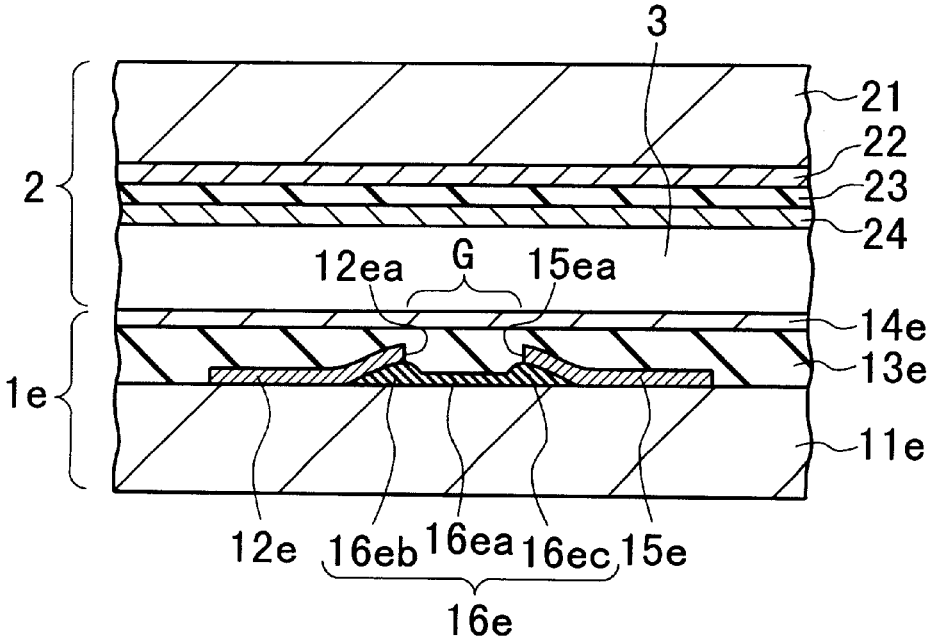
FIG. 11 is a partial plan view showing the configuration of a surface-discharge type PDP according to a fifth embodiment of the present invention, which is a fourth variation of the first embodiment of FIG. 3.

FIG. 11 shows a surface-discharge type PDP according to a fifth embodiment of the present invention, which has the same configuration as that of the PDP according to the first embodiment of FIGS. 2 to 4 except that a first component 1*e* is used instead of the first component 1*a*. Therefore, the explanation about the same configuration is omitted here for the sake of simplification by attaching the same reference symbols as those in FIG. 3 to the same elements in FIG. 11.

In the first component 1*e*, strip-shaped dielectric layers 16*e* extending along the Y direction are formed on the flat inner surface of a glass substrate 11*e* instead of the strip-shaped dielectric layers 16*a*. The layers 16*e* serve to raise the inner ends 12*ea* and 15*ea* and their vicinity of strip-shaped sustain electrodes 12*e* and 15*e*, as shown in FIG. 11.

A dielectric layer 13*e*, which is made of low melting-point glass, has an approximately flat surface. The thickness of the dielectric layer 13*e* is not constant in the direction X. The non-overlapped parts of the layer 13*e* with the dielectric layers 16*e* have a thickness of d. The overlapped parts of the layer 13*e* with the layers 16*e* have a thickness less than d. At the inner ends 12*ea* and 15*ea* of the sustain electrodes 12*e* and 15*e*, the dielectric layer 13*e* have a minimum thickness $d_0$.

A MgO layer 14*e* is formed on the flat surface of the dielectric layer 13*e*.

Unlike the first embodiment of FIG. 3, each of the strip-shaped dielectric layers 16*e* has a middle part 16*ea* thinner slightly than end parts 16*eb* and 16*ec*. In other words, the layers 16*e* are depressed in the middle part 16*ea*. The middle part 16*ea* is not overlapped with the sustain electrodes 12*e* and 15*e*.

It is needless to say the PDP according to the fifth embodiment has the same advantages as those is the first embodiment.

SIXTH EMBODIMENT

Figure 12:
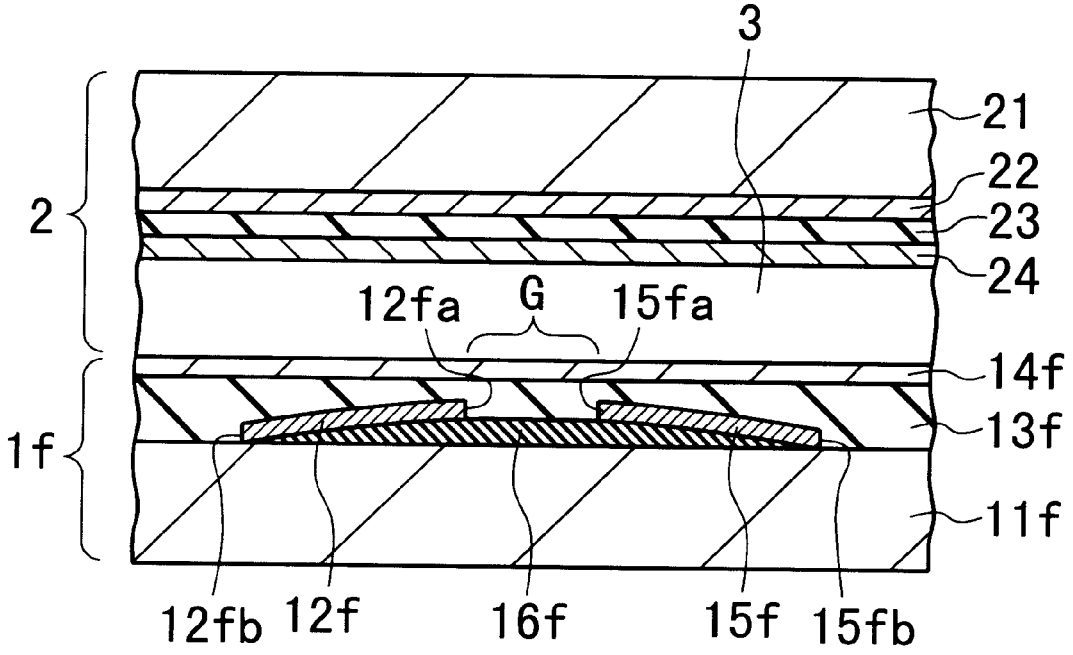
FIG. 12 is a partial plan view showing the configuration of a surface-discharge type PDP according to a sixth embodiment of the present invention, which is a fifth variation of the first embodiment of FIG. 3.

FIG. 12 shows a surface-discharge type PDP according to a sixth embodiment of the present invention, which has the same configuration as that of the PDP according to the first embodiment of FIG. 2 to 4 except that a first component 1*f* is used instead of the first component 1*a*. Therefore, the explanation about the same configuration is omitted here for the sake of simplification by attaching the same reference symbols as those in FIG. 3 to the same elements in FIG. 12.

In the first component 1*f*, strip-shaped dielectric layers 16*f* extending along the Y direction are formed on the flat inner surface of a glass substrate 11*f* instead of the strip-shaped dielectric layers 16*a*. The layers 16*f* serve to raise the inner ends 12*fa* and 15*fa* and their vicinity of strip-shaped sustain electrodes 12*f* and 15*f*, as shown in FIG. 12. Each pair of sustain electrodes 12*f* and 15*f* are approximately entirely located on a corresponding one of the dielectric layers 16*f*.

A dielectric layer 13*f*, which is made of low melting-point glass, has an approximately flat surface. The thickness of the dielectric layer 13*f* is not constant in the direction X. The overlapped parts of the layer 13*f* with the dielectric layers 16*f* have a maximum thickness d at the outer ends 12*fb* and 15*fb* of the sustain electrodes 12*f* and 15*f* and a minimum thickness $d_0$, at the inner ends 12*fa* and 15*fa* of the sustain electrodes 12*f* and 15. The thickness of the layer 13*f* increases gradually from the outer ends 12*fb* and 15*fb* of the sustain electrodes 12*f* and 15*f* to the inner ends 12*fa* and 15*fa* thereof. This thickness of the layers 16*f* is maximum at their center.

A MgO layer 14*f* is formed on the flat surface of the dielectric layers 13*f*.

It is needless to say the PDP according to the sixth embodiment has the same advantages as those in the first embodiment. Compared with the first embodiment, there is an additional advantage that the alignment error of the sustain electrodes 12*f* and 15*f* (or the gaps G) with respect to the dielectric layers 16*f* is difficult to increase, because the dielectric layers 16*f* have a larger curvature than that of the dielectric layers 16*a* in the first embodiment.

SEVENTH EMBODIMENT

Figure 13:
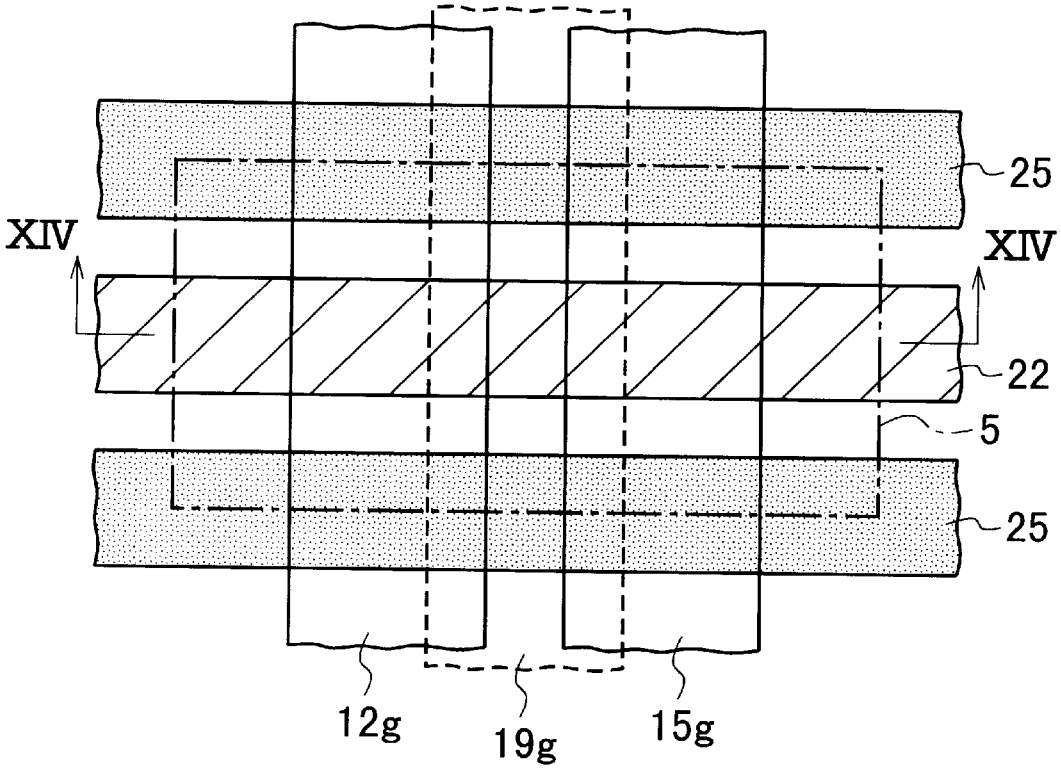
FIG. 13 is a partial plan view showing the configuration of a surface-discharge type PDP according to a seventh embodiment of the present invention.
Figure 14:
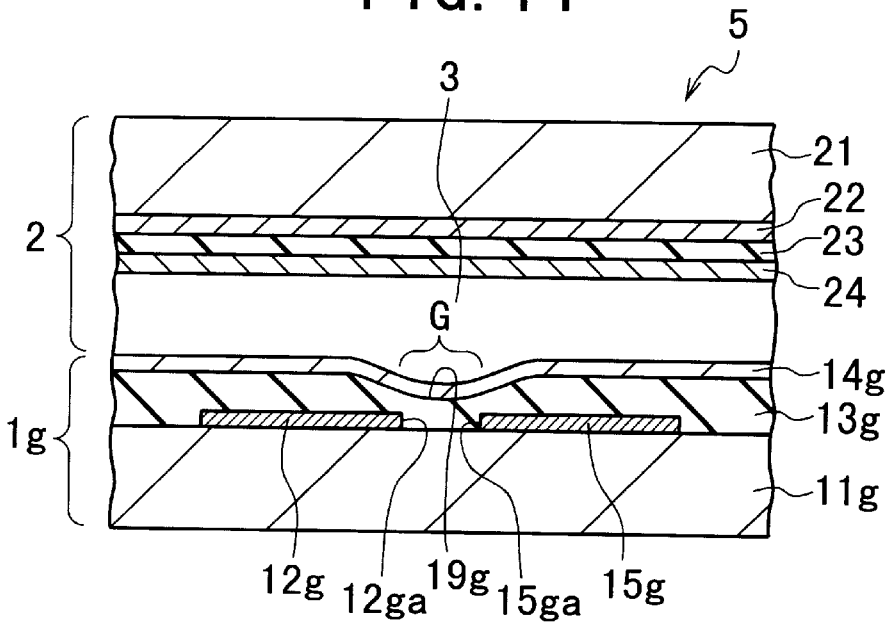
FIG. 14 is a partial cross-sectional view along the line XIV—XIV in FIG. 13.
Figure 15:
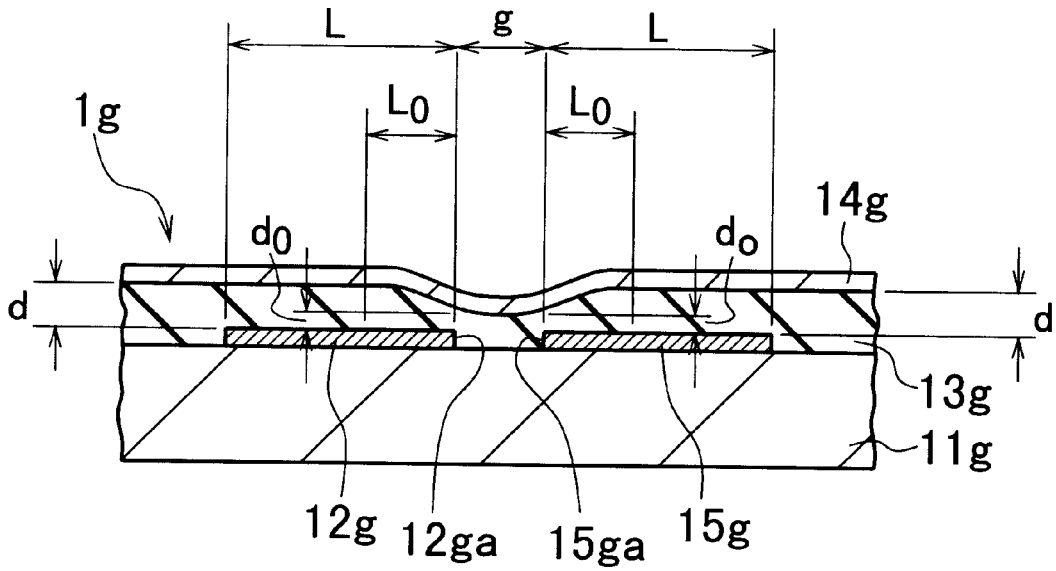
FIG. 15 is a partial cross-sectional view along the line XIV—XIV in FIG. 13, which explains the dimensions of various parts of the surface-discharge type PDP according to the seventh embodiment of FIG. 14.

FIGS. 13 to 15 show a surface-discharge type PDP according to a seventh embodiment of the present invention, which has the same configuration as that of the PDP according to the first embodiment of FIG. 2 to 4 except that a first component 1*g* is used instead of the first component 1*a*. Therefore, the explanation about the same configuration is omitted here for the sake of simplification by attaching the same reference symbols as those in FIG. 3 to the same elements in FIGS. 13 to 15.

In the first component 1*g*, pairs of strip-shaped sustain electrodes 12*g* and 15*g* are formed on the flat inner surface of a glass substrate 11*g*. Unlike the above-described first to sixth embodiments, no strip-shaped dielectric layers are formed below the sustain electrodes 12*g* and 15*g*, and no protrusion is formed on the inner surface of the substrate 11*g*. Instead, a dielectric layer 13*g*, which is made of low melting-point glass, has depressions 19*g* extending in the Y direction on its surface at an opposite side of the substrate 11*g*, as clearly shown in FIG. 14.

The depressions 19*g* of the dielectric layer 13*g* are located over the gaps G between the sustain electrodes 12*g* and 15*g*. The cross section of the depressions 19*g* is of approximately circular arc. Therefore, the thickness of the dielectric layer 13*g* is not constant in the direction X. The non-depressed parts of the layer 13*g* by the depressions 19*g* have a thickness of d. The depressed parts of the layer 13*g* due to the depressions 19*g* have a thickness less than d. At the center of the gaps G (i.e., the depressions 19*g*) near the inner ends 12*ga* and 15*ga* of the sustain electrodes 12*g* and 15*g*, the dielectric layer 13*g* have a minimum thickness $d_0$. The thickness of the layer 13*g* increases gradually from $d_0$ to d along the contour of the depressions 19*g*.

A MgO layer 14*g* is formed on the depressed surface of the dielectric layer 13*g*. The thickness of the layer 14*g* is constant.

Next, a method of fabricating the PDP according to the seventh embodiment of FIGS. 13 to 15 is explained below with reference to FIGS. 16A to 16F.

The first plate-shaped component 1*g* is fabricated in the following way.

Figure 16A:
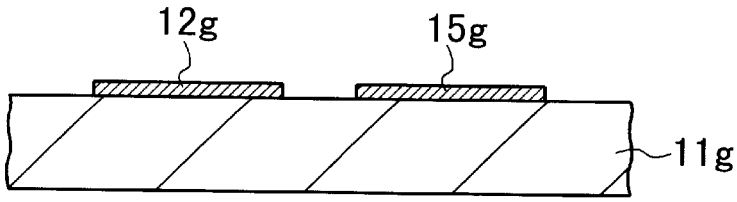
FIGS. 16A to 16F are partial cross-sectional views along the line XIV—XIV in FIG. 13, respectively, which show a method of fabricating the first substrate of the surface-discharge type PDP according to the seventh embodiment of FIG. 14.
Figure 16B:
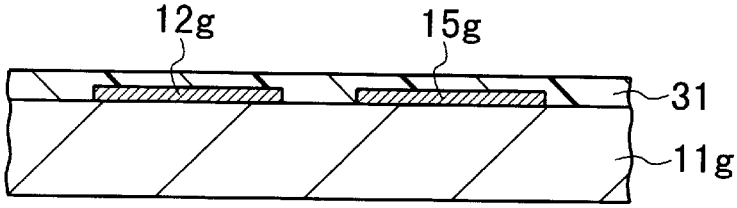

First, the strip-shaped sustain electrodes 12*g* and 15*g* are formed on the flat inner surface of the glass substrate 11*g*, as shown in FIG. 16A. Next, a dielectric paste containing a low-melting point glass at its main constituent is applied or coated on the whole surface of the glass substrate 11*g*, forming a dielectric paste layer 31 to cover the sustain electrodes 12*g* and 15*g*, as shown in FIG. 16B.

Figure 16C:
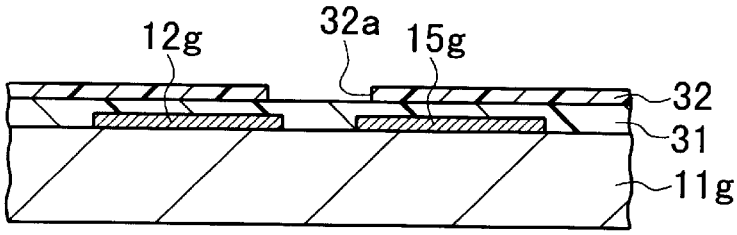
Figure 16D:
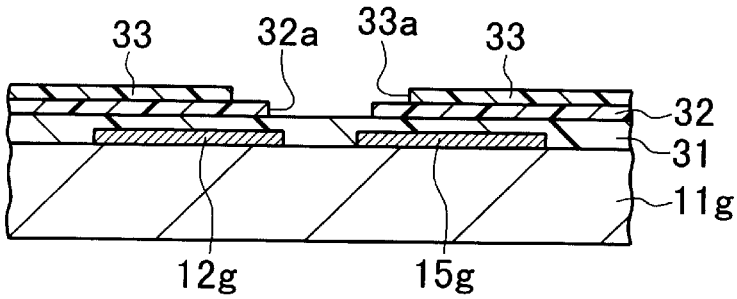

A dielectric paste layer 32 having the same composition as the dielectric paste layer 31 is formed on the layer 31 except for areas corresponding to the strip-shaped depressions 19*g*. Thus, the layer 32 has strip-shaped windows 32*a* over the gaps G between the sustain electrodes 12*g* and 15*g*, as shown in FIG. 16C. Another dielectric paste layer 33 having the same composition as that of the dielectric paste layer 31 is formed on the layer 32 except for areas corresponding to the depressions 19*g*. Thus, the layer 33 has strip-shaped windows 33*a* over the gap G and the windows 32*a*, as shown in FIG. 16D. The windows 33*a* are wider than the windows 32*a*.

Figure 16E:
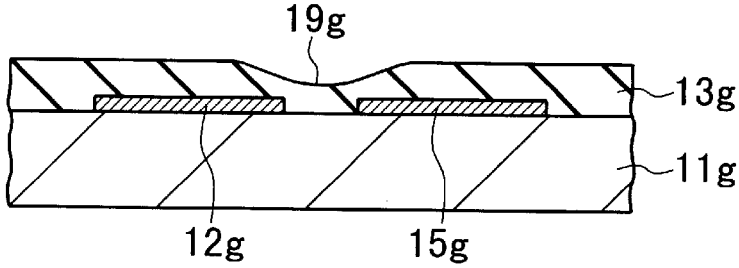

Subsequently, the three dielectric paste layers 31, 32, and 33 are sintered. As a result, these layers 31, 32, and 33 are combined together to form the dielectric layer 13*g* having the depressions 19*g*, as shown in FIG. 16E.

Figure 16F:
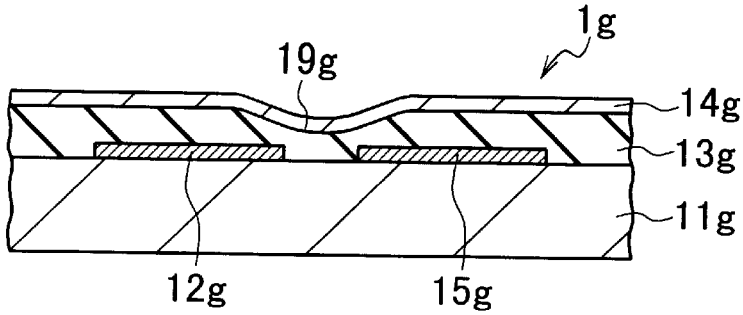

Furthermore, the MgO layer 14*h* is formed on the dielectric layer 13*g*, as shown in FIG. 16F. Thus, the first component 1*g* is fabricated.

A pressing process may be used to form the depressions 19*g* of the dielectric layer 13*g*.

It is needless to say the PDP according to the seventh embodiment has the same advantages as those in the first embodiment. Compared with the first embodiment, there is an additional advantage that the sustain electrodes 12*g* and 15*g* can be readily and accurately formed on the substrate 11*g*, because the sustain electrodes 12*g* and 15*g* are directly formed on the flat inner surface of the substrate 11*g*.

EIGHTH EMBODIMENT

Figure 17:
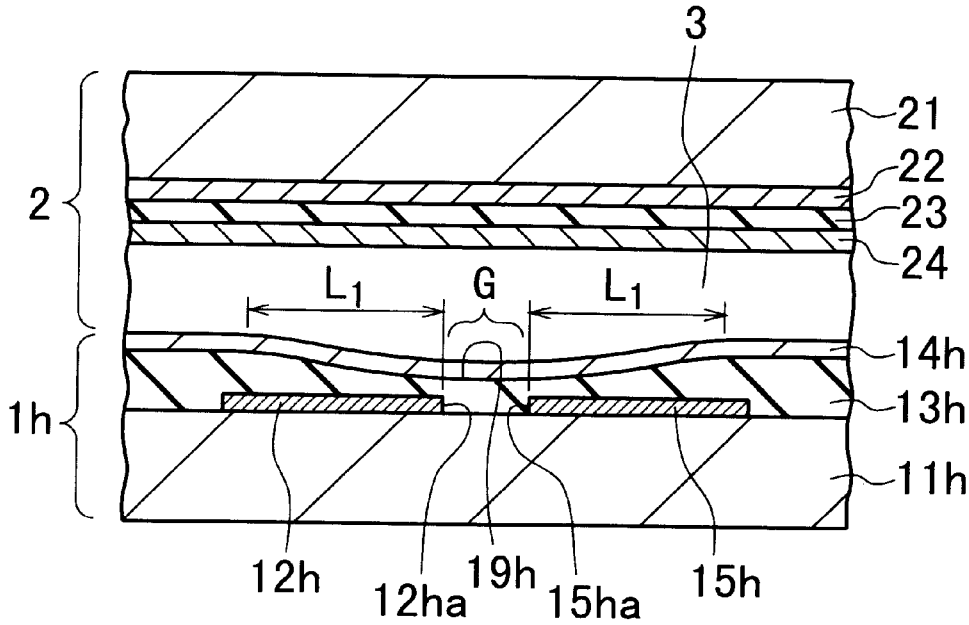
FIG. 17 is a partial plan vuew showing the configuration of a surface-discharge type PDP according to an eighth embodiment of the present invention, which is a variation of the seventh embodiment of FIG. 14.

FIG. 17 show a surface-discharge type PDP according to an eighth embodiment of the present invention, which has the same configuration as that of the PDP according to the third embodiment of FIG. 13 to 15 except that a first component 1*h* is used instead of the first component 1*g*. Therefore, the explanation about the same configuration is omitted here for the sake of simplification by attaching the same reference symbols as those in FIGS. 14 to the same elements in FIG. 17.

In the first component 1*h*, pairs of strip-shaped sustain electrodes 12*h* and 15*h* are formed on the flat inner surface of a glass substrate 11*h*.

A dielectric layer 13*h*, which is made of low melting-point glass, has strip-shaped depression 19*h* on its surface. The depressions 19*h* are located over the gaps G between the sustain electrodes 12*h* and 15*h* extend in the Y direction. The cross section of the depressions 19*h* is of approximately circular arc; however, the radius of curvature of the depressions 19*h* is larger than that of the depression 19*g* shown in the seventh embodiment of FIG. 14. The overlapped parts of the electrodes 12*h* and 15*h* with the depressions 19*h* have a width of $L_1$ less slightly than the width L of the electrodes 12*h* and 15*h*, where $L_1 > L_0$.

The thickness of the dielectric layer 13*h* is not constant in the direction X. The non-depressed parts of the layer 13*h* by the depressions 19*h* have a thickness of d. The depressed parts of the layer 13*h* by the depressions 19*h* have a thickness less than d. At the center of the gaps G near the inner ends 12*ha* and 15*ha* of the sustain electrodes 12*h* and 15*h*, the dielectric layer 13*h* have a minimum thickness $d_0$. The thickness of the layer 13*h* increases gradually from $d_0$ to d along the contour of the depressions 19*h*.

A MgO layer 14*h* is formed on the depressed surface of the dielectric layer 13*h*. The thickness of the layer 14*h* is constant.

It is needless to say the PDP according to the eighth embodiment has the same advantages as those in the first embodiment. Compared with the first embodiment, there is an additional advantage that the alignment error of the sustain electrodes 12*h* and 15*h* (or the gaps G) with respect to the depressions 19*h* of the dielectric layers 16*h* is difficult to increase, because the depressions 19*h* have a larger curvature than that of the dielectric layers 16*a* in the first embodiment.

NINTH EMBODIMENT

Figure 18:
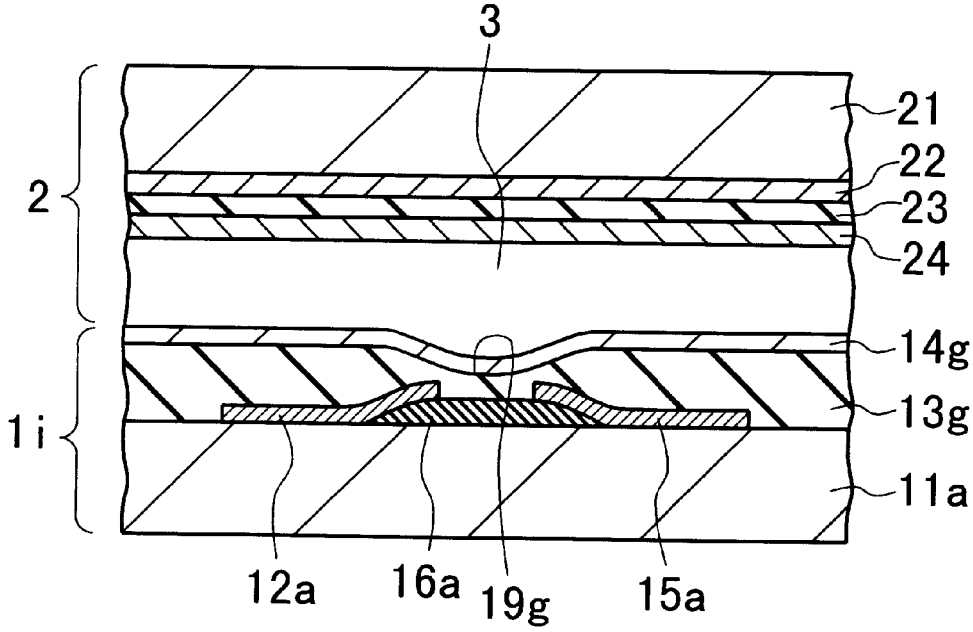
FIG. 18 is a partial plan view showing the configuration of a surface-discharge type PDP according to a ninth embodiment of the present invention, which is the combination of the first and seventh embodiments of FIGS. 3 and 14.

FIG. 18 shows a surface-discharge type PDP according to a ninth embodiment of the present invention, which has the same configuration as that of the PDP according to the first embodiment of FIGS. 2 to 4 except that a first component 1*i* is used instead of the first component 1*a*. Therefore, the explanation about the same configuration is omitted here for the sake of simplification by attaching the same reference symbols as those in FIG. 3 to the same elements in FIG. 18.

The PDP according to the ninth embodiment is equivalent to the combination of the PDPs according to the first and seventh embodiments of FIGS. 3 and 14.

In the first component 1*i*, as shown in FIG. 18, the strip-shaped dielectric layers 16*a*, which are used in the PDP according to the first embodiment, are formed on the flat inner surface of the glass substrate 11*a*. Also, the strip-shaped sustain electrodes 12*a* and 15*a*, which are used in the PDP according to the first embodiment, are formed on the surface of the glass substrate 11*a* to overlap with the dielectric layers 16*a*.

The dielectric layer 13*g* having the depression 19*g*, which are used in the PDP according to the seventh embodiment, are formed on the surface of the glass substrate 11*a* to cover the dielectric layers 16*a* and the sustain electrodes 12*a* and 15*a*. The MgO layer 14*g*, which is used in the PDP according to the seventh embodiment, is formed on the dielectric layer 13*g* .

It is needless to say the PDP according to the ninth embodiment has the same advantages as those in the first embodiment. There is an additional advantage that the thickness of the dielectric layer 13*g* can be readily changed within the gaps G and the outside the gaps G.

TENTH EMBODIMENT

Figure 19:
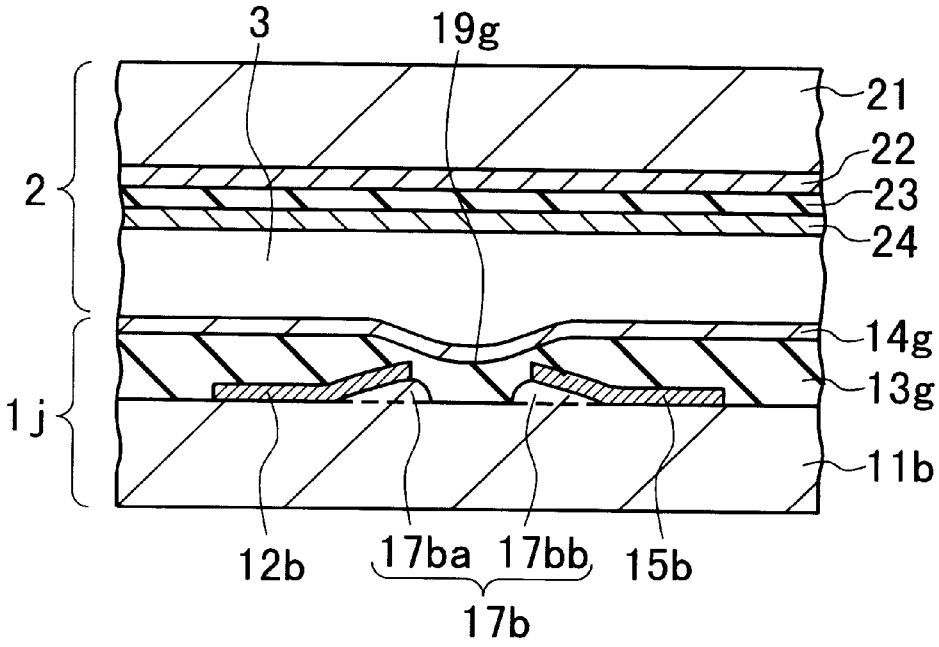
FIG. 19 is a partial plan view showing the configuration of a surface-discharge type PDP according to a tenth embodiment of the present invention, which is the combination of the second and seventh embodiments of FIGS. 9 and 14.

FIG. 19 shows a surface-discharge type PDP according to a tenth embodiment of the present invention, which has the same configuration as that of the PDP according to the second embodiment of FIG. 8 except that a first component l*j* is used instead of the first component 1*a*. Therefore, the explanation about the same configuration is omitted here for the sake of simplification by attaching the same reference symbols as those in FIG. 8 to the same elements in FIG. 19.

The PDP according to the tenth embodiment is equivalent to the combination of the PDPs according to the second and seventh embodiments of FIGS. 8 and 14.

As shown in FIG. 19, the first component 1*j* includes the glass substrate 11*b* having the pairs 17*b* of protrusions 17*ba* and 17*bb* of the glass substrate 11*b*, which are used in the PDP according to the second embodiment. Also, the component 1*j* includes the dielectric layer 13*g* having the depression 19*g* and the MgO layer 14*g*, which are used in the PDP according to the seventh embodiment.

It is needless to say the PDP according to the tenth embodiment has the same advantages as those in the first embodiment.

ELEVENTH EMBODIMENT

Figure 20:
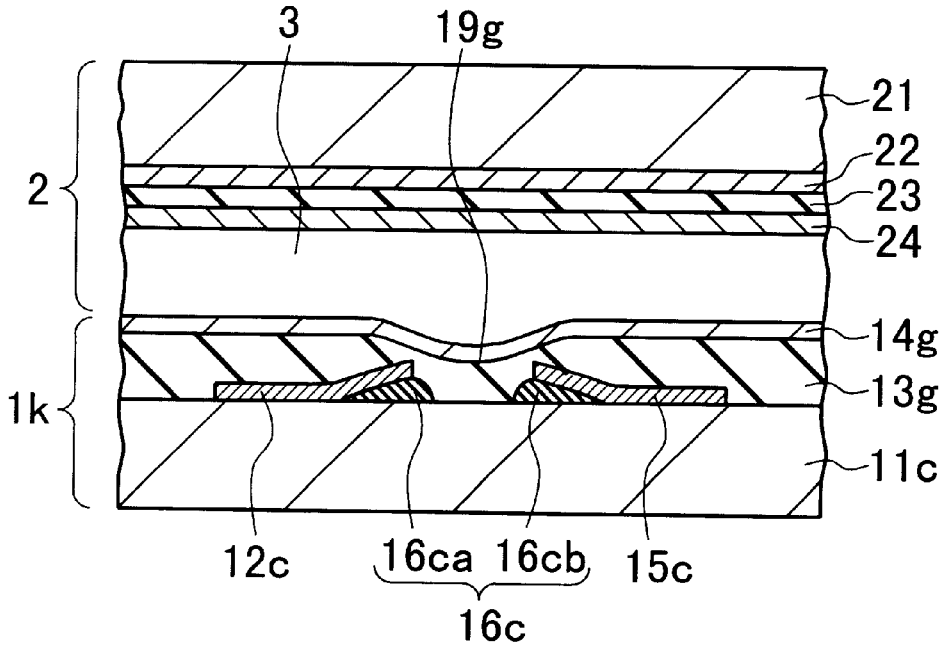
FIG. 20 is a partial plan view showing the configuration of a surface-discharge type PDP according to an eleventh embodiment of the present invention, which is the combination of the third and seventh embodiments of FIGS. 9 and 14.

FIG. 20 shows a surface-discharge type PDP according to an eleventh embodiment of the present invention, which has the same configuration as that of the PDP according to the third embodiment of FIG. 9 except that a first component 1*k* is used instead of the first component 1*b*. Therefore, the explanation about the same configuration is omitted here for the sake of simplification by attaching the same reference symbols as those in FIG. 9 to the same elements in FIG. 20.

The PDP according to the eleventh embodiment is equivalent to the combination of the PDPs according to the third and seventh embodiments of FIGS. 9 and 14.

As shown in FIG. 20, the first component 1*k* includes the glass substrate 11*c*, the pairs 16*c* of strip-shaped dielectric layers 16*ca* and 16*cb*, which are used in the PDP according to the second embodiment. Also, the component 1*k* includes the dielectric layer 13*g* having the depressions 19*g* and the MgO layer 14*g*, which are used in the PDP according to the seventh embodiment.

It is needless to say the PDP according to the eleventh embodiment has the same advantages as those in the first embodiment.

TWELFTH EMBODIMENT

Figure 21:
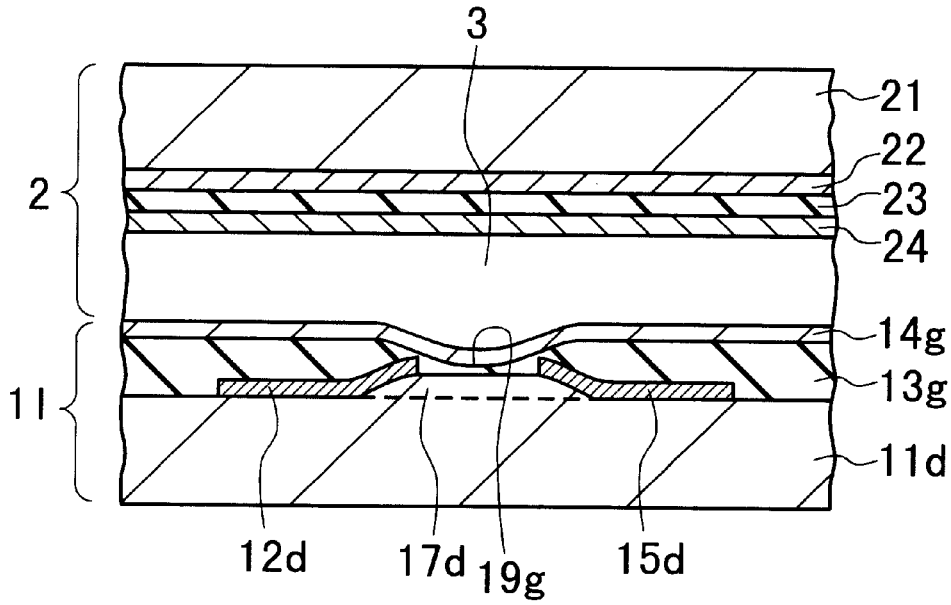
FIG. 21 is a partial plan view showing the configuration of a surface-discharge type PDP according to a twelfth embodiment of the present invention, which is the combination of the fourth and seventh embodiments of FIG. 10 and 14.

FIG. 21 shows a surface-discharge type PDP according to a twelfth embodiment of the present invention, which has the same configuration as that of the PDP according to the fourth embodiment of FIG. 10 except that a first component 11 is used instead of the first component 1*c*. Therefore, the explanation about the same configuration is omitted here for the sake of simplification by attaching the same reference symbols as those in FIG. 10 to the same elements in FIG. 21.

The PDP according to the twelfth embodiment is equivalent to the combination of the PDPs according to the fourth and seventh embodiments of FIGS. 10 and 14.

As shown in FIG. 21, the first component 11 includes the glass substrate 11*d* having the stri-shaped protrusions 17*d* and the strip-shaped sustain electrodes 12*d* and 15*d*, which are used in the PDP according to the fourth embodiment. Also, the component 11 includes the dielectric layer 13*g* having the depressions 19*g* and the MgO layer 14*g*, which are used in the PDP according to the seventh embodiment.

It is needless to say the PDP according to the twelfth embodiment has the same advantages as those in the first embodiment.

THIRTEENTH EMBODIMENT

Figure 22:
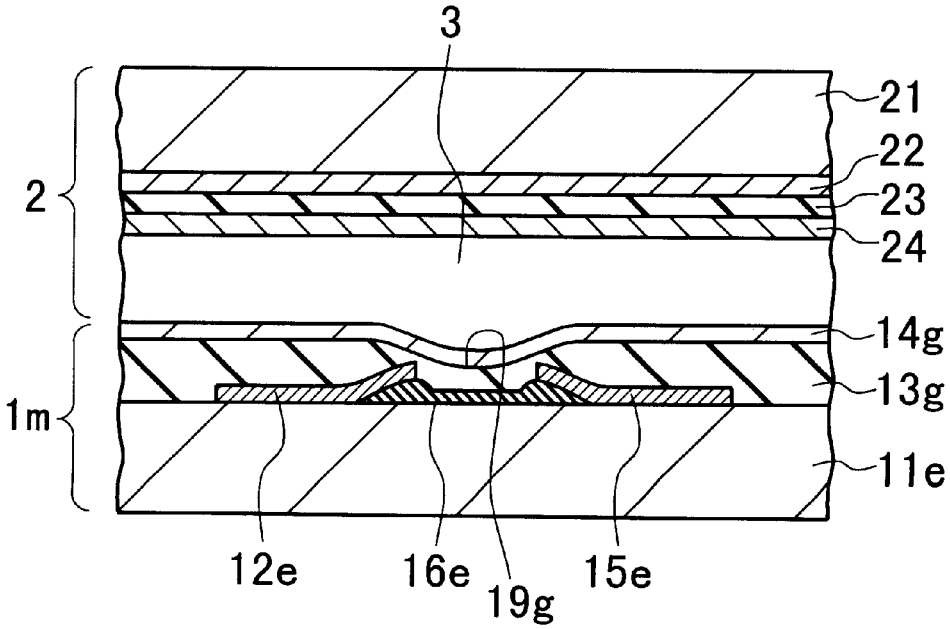
FIG. 22 is a partial plan view showing the configuration of a surface-discharge type PDP according to a thirteenth embodiment of the present invention, which is the combination of the fifth and seventh embodiments of FIGS. 11 and 14.

FIG. 22 shows a surface-discharge type PDP according to a thirteenth embodiment of the present invention, which has the same configuration as that of the PDP according to the fifth embodiment of FIG. 11 except that a first component 1*m* is used instead of the first component 1*e*. Therefore, the explanation about the same configuration is omitted here for the sake of simplification by attaching the same reference symbols as those in FIG. 11 to the same elements in FIG. 22.

The PDP according to the thirteenth embodiment is equivalent to the combination of the PDPs according to the fifth and seventh embodiments of FIGS. 11 and 14.

As shown in FIG. 22, the first component 1*m* includes the glass substrate 11*e*, the strip-shaped dielectric layers 16*e*, and the strip-shaped sustain electrodes 12*e* and 15*e*, which are used in the PDP according to the fifth embodiment. Also, the component 1*m* includes the dielectric layer 13*g* having the depressions 19*g* and the MgO layer 14*g*, which are used in the PDP according to the seventh embodiment.

It is needless to say the PDP according to the thirteenth embodiment has the same advantages as those in the first embodiment.

FOURTEENTH EMBODIMENT

Figure 23:
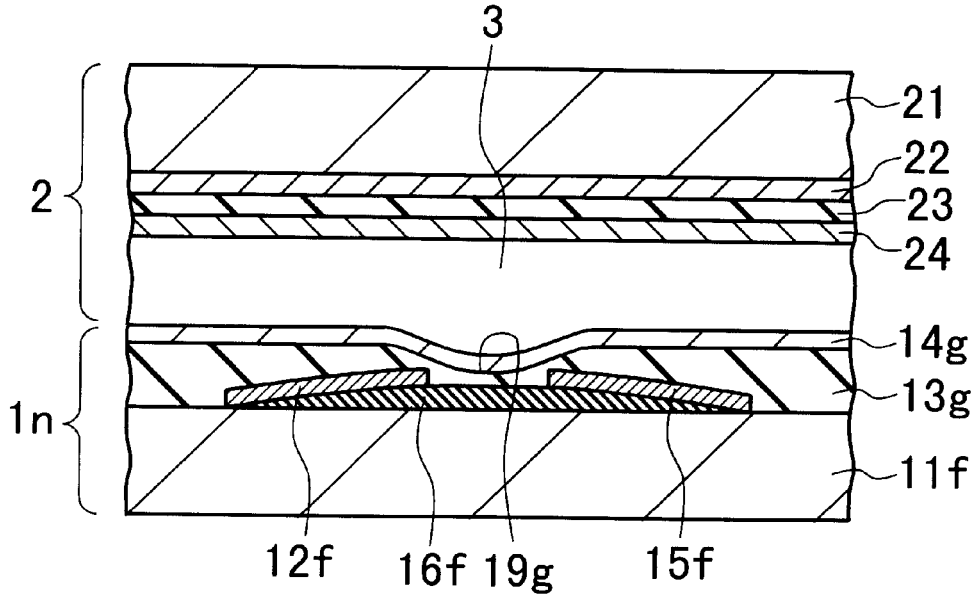
FIG. 23 is a partial plan view showing the configuration of a surface-discharge type PDP according to a fourteenth embodiment of the present invention, which is the combination of the sixth and seventh embodiments of FIG. 12 and 14.

FIG. 23 shows a surface-discharge type PDP according to a fourteenth embodiment of the present invention, which has the same configuration as that of the PDP according to the sixth embodiment of FIG. 12 except that a first component 1*n* is used instead of the first component 1*f*. Therefore, the explanation about the same configuration is omitted here for the sake of simplification by attaching the same reference symbols as those in FIG. 12 to the same elements in FIG. 23.

The PDP according to the thirteenth embodiment is equivalent to the combination of the PDPs according to the fifth and seventh embodiments of FIGS. 12 and 14.

As shown in FIG. 23, the first component 1*n* includes the glass substrate 11*f*, the strip-shaped dielectric layers 16*f*, and the strip-shaped sustain electrodes 12*f* and 15*f*, which are used in the PDP according to the sixth embodiment. Also, the component 1*n* includes the dielectric layer 13*g* having the depressions 19*g* and the MgO layer 14*g*, which are used in the PDP according to the seventh embodiment.

It is needless to say the PDP according to the fourteenth embodiment has the same advantages as those in the first embodiment.

FIFTEENTH EMBODIMENT

Figure 24:
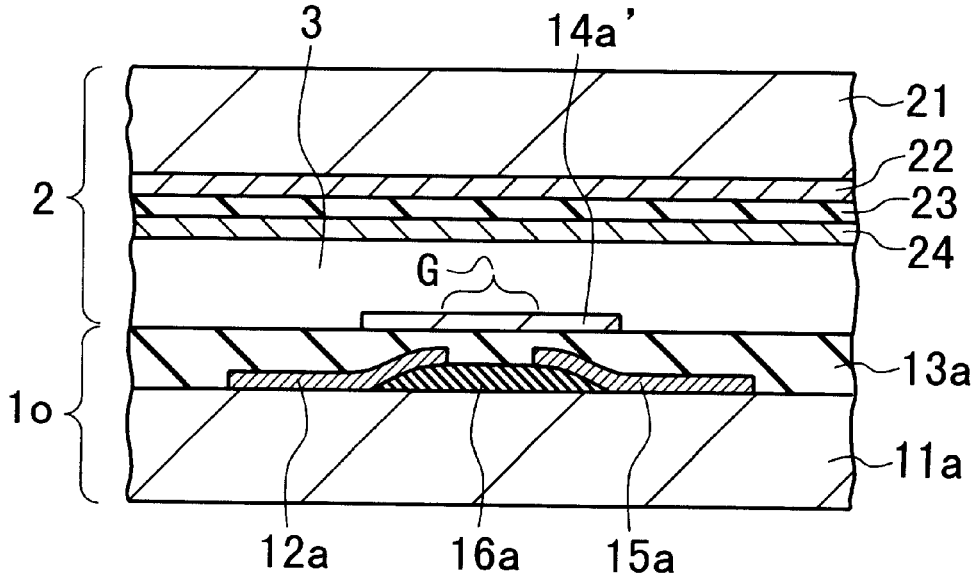
FIG. 24 is a partial plan view showing the configuration of a surface-discharge type PDP according to a fifteenth embodiment of the present invention, which is a sixth variation of the first embodiment of FIG. 3.

FIG. 24 shows a surface-discharge type PDP according to a fifteenth embodiment of the present invention, which has the same configuration as that of the PDP according to the first embodiment of FIG. 3 except that a MgO layer 14*a*' is selectively formed on the dielectric layer 13*a* in a first component 1*o*. Therefore, the explanation about the same configuration is omitted here for the sake of simplification by attaching the same reference symbols as those in FIG. 3 to the same elements in FIG. 24.

As shown in FIG. 24, the patterned MgO layer 14*a*' exists on the locations just over the strip-shaped dielectric layers 16*a* in the first component 1*o*. In other words, the MgO layer 14*a*' only covers the protruded parts of the sustain electrodes 12*a* and 15*a*.

It is needless to say the PDP according to the fifteenth embodiment has the same advantages as those in the first embodiment.

SIXTEENTH EMBODIMENT

Figure 25:
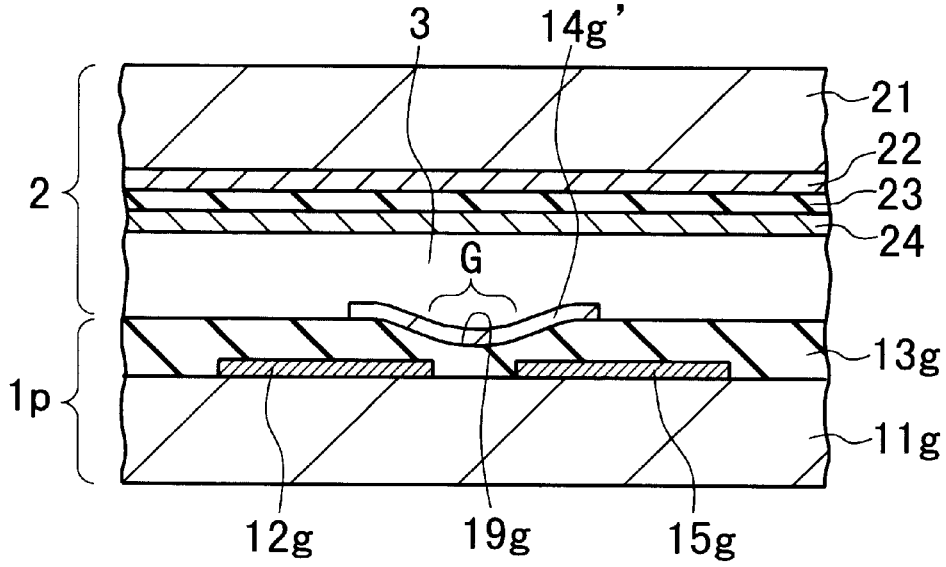
FIG. 25 is a partial plan view showing the configuration of a surface-discharge type PDP according to a sixteenth embodiment of the present invention, which is a variation of the seventh embodiment of FIG. 14.

FIG. 25 shows a surface-discharge type PDP according to a sixteenth embodiment of the present invention, which has the same configuration as that of the PDP according to the seventh embodiment of FIG. 14 except that a MgO layer 14*g*' is selectively formed on the dielectric layer 13*g* in a first component 1*p*. Therefore, the explanation about the same configuration is omitted here for the sake of simplification by attaching the same reference symbols as those in FIG. 14 to the same elements in FIG. 25.

As shown in FIG. 25, the patterned MgO layer 14*g*' exists on the locations just over the strip-shaped depressions 19*g* ant its periphery in the first component 1*p*. In other words, the MgO layer 14*g*' only covers the parts of the sustain electrodes 12*a* and 15*a* located in the depressions 19*g*.

It is needless to say the PDP according to the sixteenth embodiment has the same advantages as those in the first embodiment.

SEVENTEENTH EMBODIMENT

Figure 26:
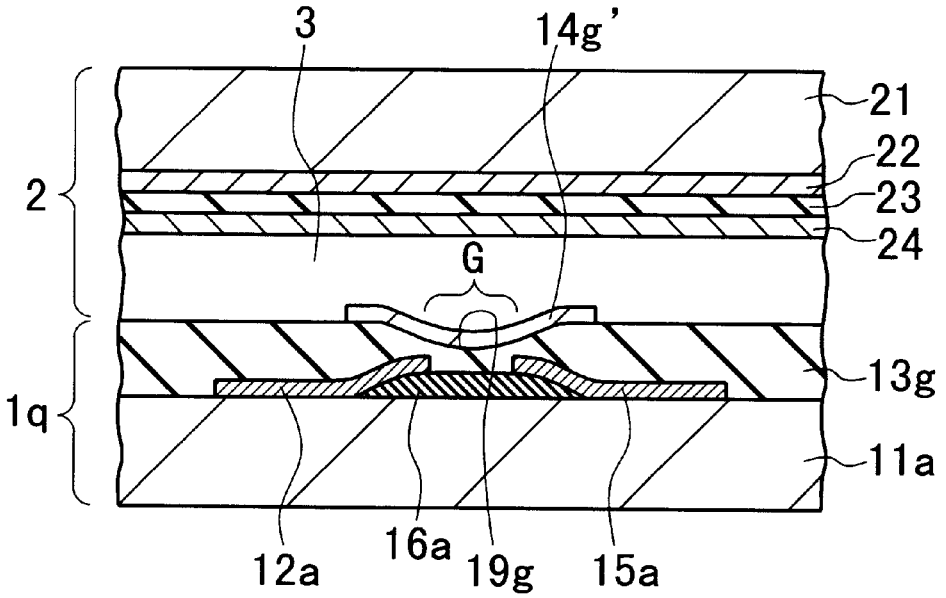
FIG. 26 is a partial plan view showing the configuration of a surface-discharge type PDP according to a seventeenth embodiment of the present invention, which is a variation of the ninth embodiment of FIG. 18.

FIG. 26 shows a surface-discharge type PDP according to a seventeenth embodiment of the present invention, which has the same configuration as that of the PDP according to the ninth embodiment of FIG. 18 except that a MgO layer 14*g*' is selectively formed on the dielectric layer 13*g* in a first component 1*q*. Therefore, the explanation about the same configuration is omitted here for the sake of simplification by attaching the same reference symbols as those in FIG. 18 to the same elements in FIG. 26.

As shown in FIG. 26, the patterned MgO layer 14*g*' exists on the locations just over the strip-shaped depressions 19*g* and its periphery in the first component 1*q*. In other words, the MgO layer 14*g*' only covers the raised parts of the sustain electrodes 12*a* and 15*a* located in the depressions 19*g*.

It is needless to say the PDP according to the seventeenth embodiment has the same advantages as those in the first embodiment.

EIGHTEENTH EMBODIMENT

Figure 27:
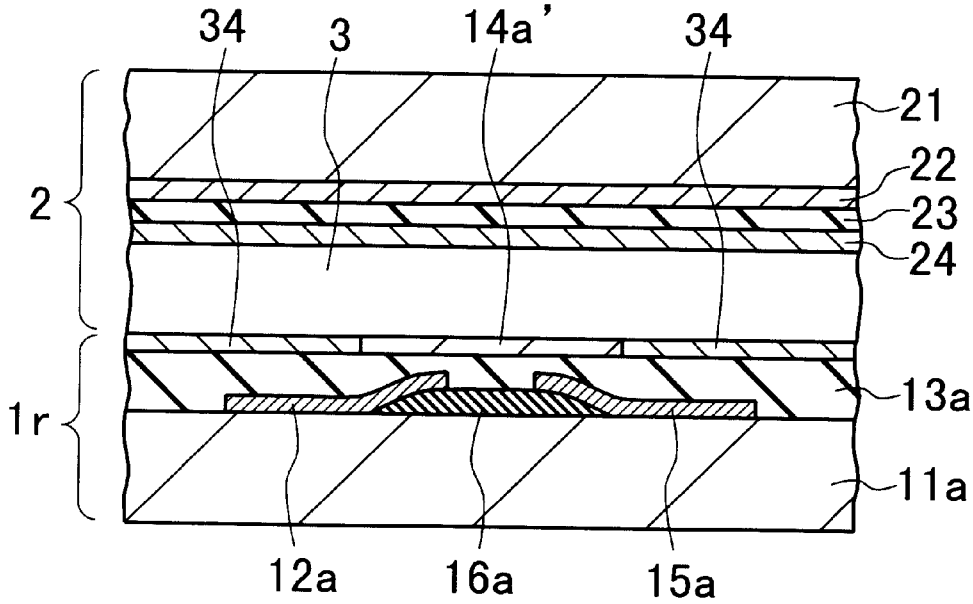
FIG. 27 is a partial plan view showing the configuration of a surface-discharge type PDP according to an eighteenth embodiment of the present invention, which is a variation of the fifteenth embodiment of FIG. 24.

FIG. 27 shows a surface-discharge type PDP according to an eighteenth embodiment of the present invention, which has the same configuration as that of PDP according to the fifteenth embodiment of FIG. 24 except that a fluorescent layer 34 is selectively formed on the exposed area of the dielectric layer 13*a* from the MgO layer 14*a*' in a first component 1*r*. Therefore, the explanation about the same configuration is omitted here for the sake of simplification by attaching the same reference symbols as those in FIG. 24 to the same elements in FIG. 27.

As shown in FIG. 27, the patterned MgO layer 14*a*' exists only on the locations just over the strip-shaped dielectric layers 16*a* in the first component 1*r*. In other words, the MgO layer 14*a*' only covers the raised parts of the sustain electrodes 12*a* and 15*a*. Also, the exposed areas of the dielectric layer 13*a* is covered with the fluorescent layer 34.

It is needless to say the PDP according to the eighteenth embodiment has the same advantages as those in the first embodiment.

Moreover, in the PDP according to the eighteenth embodiment, since the fluorescent layer 34 is formed on the dielectric layer 13*a*, the layer 34 is applied with UV light emitted in the discharge spaces 3, thereby exciting the fluorescent material in the layer 34. Accordingly, there is an additional advantage that the UV light emitted in the space s can be effectively utilized, which improves the light-emitting efficiency. Also, there is another additional advantage that the fluorescent layer 34 is difficult to be degraded due to ion bombardment because the discharge current density is limited in the layer 34.

NINETEENTH EMBODIMENT

Figure 28:
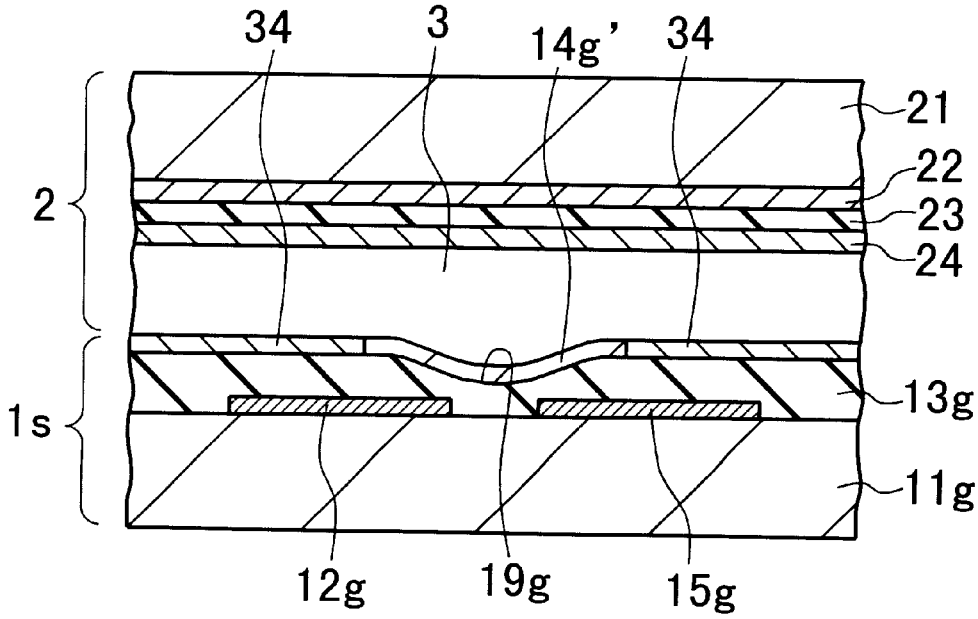
FIG. 28 is a partial plan view showing the configuration of a surface-discharge type PDP according to a nineteenth embodiment of the present invention, which is a variation of the sixteenth embodiment of FIG. 25.

FIG. 28 shows a surface-discharge type PDP according to a nineteenth embodiment of the present invention, which has the same configuration as that of the PDP according to the sixteenth embodiment of FIG. 25 except that a fluorescent layer 34 is formed on the exposed area of the dielectric layer 13*g* from the patterned MgO layer 14*g*' in a first component 1*s*. Therefore, the explanation about the same configuration is omitted here for the sake of simplification by attaching the same reference symbols as those in FIG. 26 to the same elements in FIG. 28.

As shown in FIG. 28, the patterned MgO layer 14*g*' exists only the locations just over the strip-shaped depressions 19*g* in the first component 1*s*. In other words, the MgO layer 14*g*' only covers the parts of the sustain electrodes 12*g* and 15*g* in the depressions 19*g*. Also, the exposed areas of the dielectric layer 13*g* is covered with the fluorescent layer 34.

It is needless to say the PDP according to the nineteenth embodiment has the same advantages as those in the eighteenth embodiment.

TWENTIETH EMBODIMENT

Figure 29:
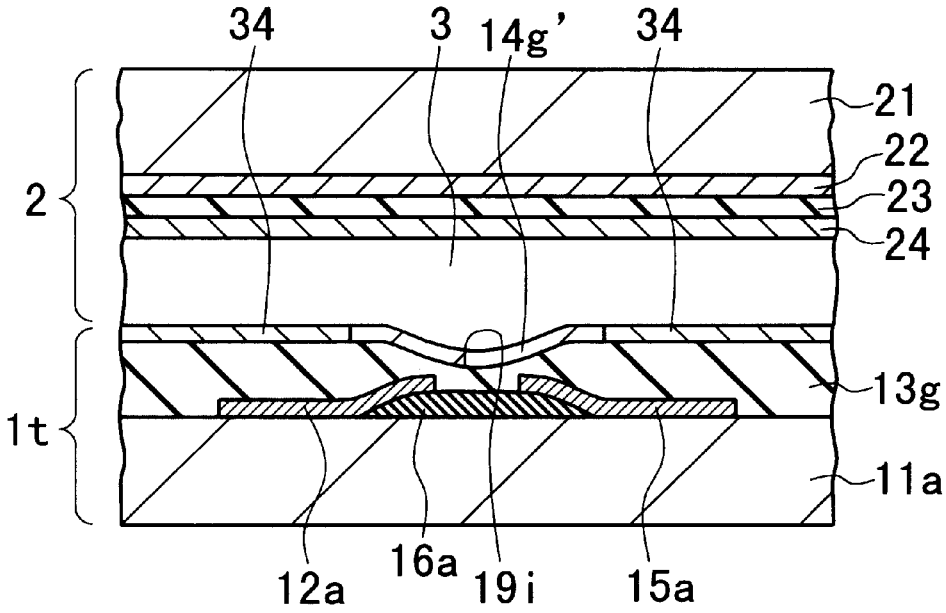
FIG. 29 is a partial plan view showing the configuration of a surface-discharge type PDP according to a twentieth embodiment of the present invention, which is a variation of the seventeenth embodiment of FIG. 26.

FIG. 29 shows a surface-discharge type PDP according to a twentieth embodiment of the present invention, which has the same configuration as that of the PDP according to the seventeenth embodiment of FIG. 26 except that a fluorescent layer 34 is formed on the exposed area of the dielectric layer 13*g* from the patterned MgO layer 14*g*' in a first component 1*t*. Therefore, the explanation about the same configuration is omitted here for the sake of simplification by attaching the same reference symbols as those in FIG. 26 to the same elements in FIG. 29.

As shown in FIG. 29, the patterned MgO layer 14*g*' exists only on the locations just over the strip-shaped depressions 19*i* in the first component 1*t*. In other words, the MgO layer 14*g*' only covers the parts of the sustain electrodes 12*a* and 15*a* in the depressions 19*i*. Also, the exposed areas of the dielectric layer 13*g* is covered with the fluorescent layer 34.

It is needless to say the PDP according to the twentieth embodiment has the same advantages as those in the eighteenth embodiment.

Additionally, in the above-described eighteenth to twentieth embodiments, a MgO layer may be additionally formed on or below the fluorescent layer 34.

TWENTY-FIRST EMBODIMENT

Figure 30:
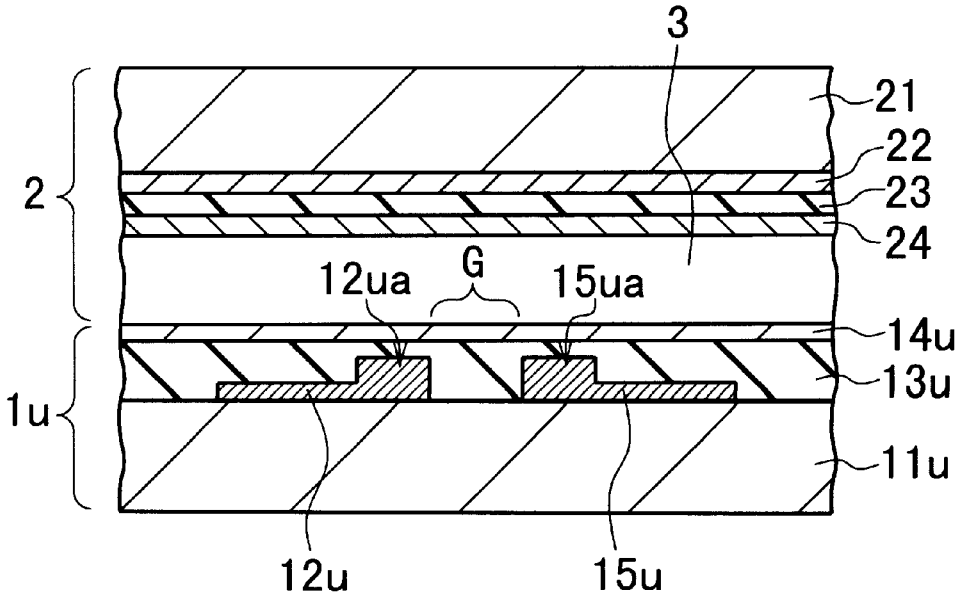
FIG. 30 is a partial plan view showing the configuration of a surface-discharge type PDP according to a twenty-first embodiment of the present invention.

FIG. 30 shows a surface-discharge type PDP according to a twenty-first embodiment of the present invention, in which strip-shaped sustain electrodes 12*u* and 15*u* themselves have protrusions 12*ua* and 15*ua* at their inner ends in a first component 1*u*. The sustain electrodes 12*u* and 15*u* are formed on the inner flat surface of a glass substrate 11*u*. The electrodes 12*u* and 15*u* are covered with a dielectric layer 13*u*. The flat surface of the dielectric layer 13*u* is covered with a MgO layer 14*u*.

The second component 2 has the same configuration as that of the first embodiment of FIG. 3.

It is needless to say the PDP according to the twenty-first embodiment has the same advantages as those in the first embodiment.

TESTS

The discharge-sustaining voltage and the light-emitting efficiency of the PDPs according to the first to fourteenth embodiments and the above-described prior-art PDP were practically fabricated while changing the values of the discharge gap g, the widths L, $L_0$, and $L_1$, and the thickness d and $d_0$ and then, they were tested and evaluated by the inventors. Thus, the following results were obtained.

In the PDP according to the first embodiment, the discharge-sustaining voltage was lower than that of the prior-art PDP under the condition that the value of the thickness d was kept unchanged. This characteristic was independent of the change in value of the discharge gap g, the widths L and $L_0$, and/or the thickness $d_0$.

Figure 31:
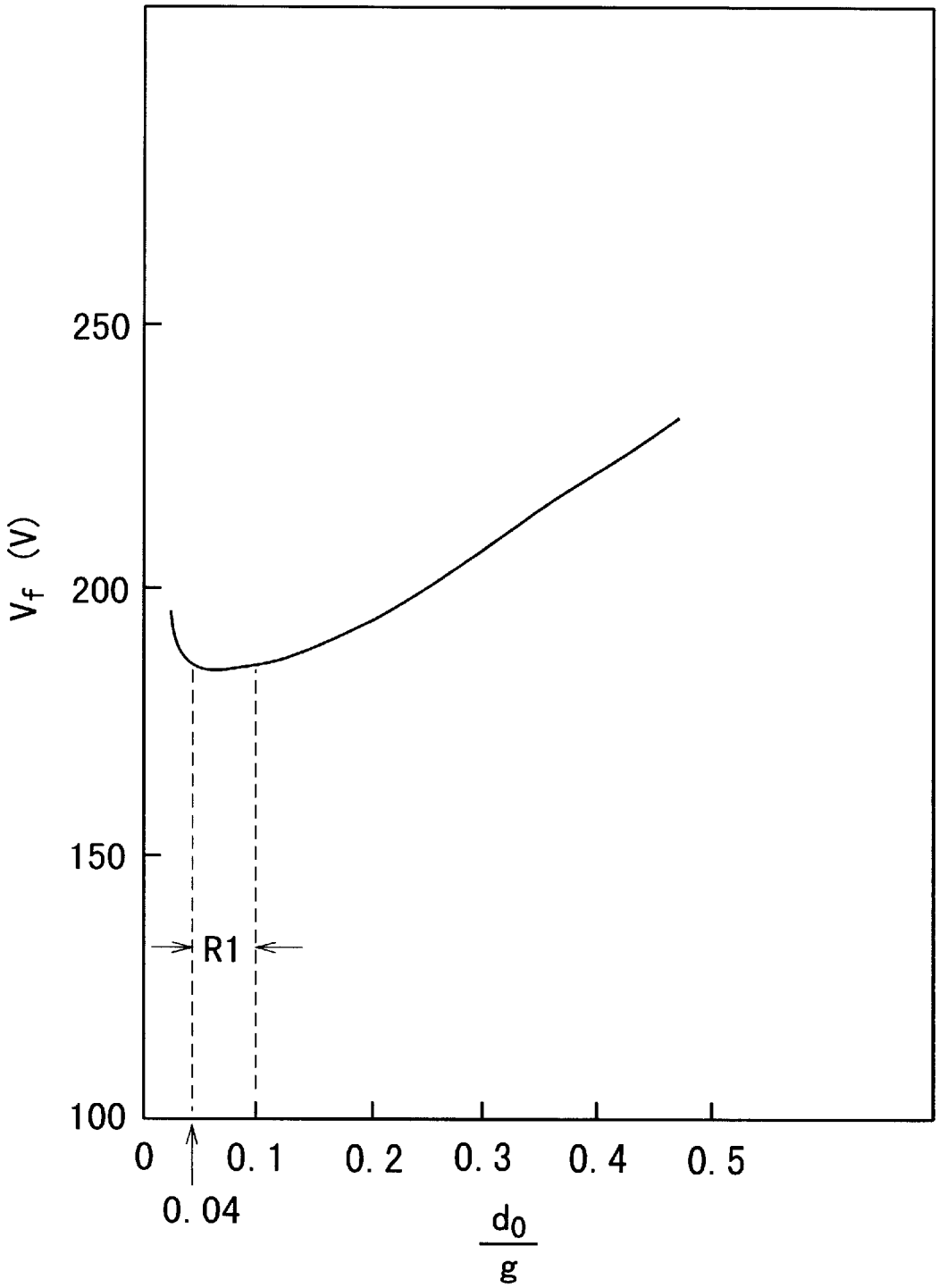
FIG. 31 is a graph showing the relationship between the voltage $V_f$ and the ratio ($d_0$/g) of the surface-discharge type PDP according to the first embodiment of FIG. 3.

Also, when the values of the minimum thickness $d_0$ was adjusted so as to have the equal discharge-sustaining voltage to each other while changing the values of the discharge gap g, the widths L, and/or the thickness d, the light-emitting efficiency was higher than that of the prior-art PDP. The improvement of this efficiency was clearly seen when the ratio ($d_0$/g) was in the range R1 from 0.04 to 0.1 in FIG. 31. As seen from FIG. 31, the discharge-starting voltage $V_f$ (V) is minimized in the range R1.

The improvement of the efficiency was clearly seen when the ratio ($d_0$/d) was in the range from 0.5 to 0.7. If ($d_0$/d) was less than 0.5, the sustain electrodes are difficult to be formed. If ($d_0$/d) was greater than 0.7, the discharge-starting voltage could not be lowered satisfactorily.

Figure 32:
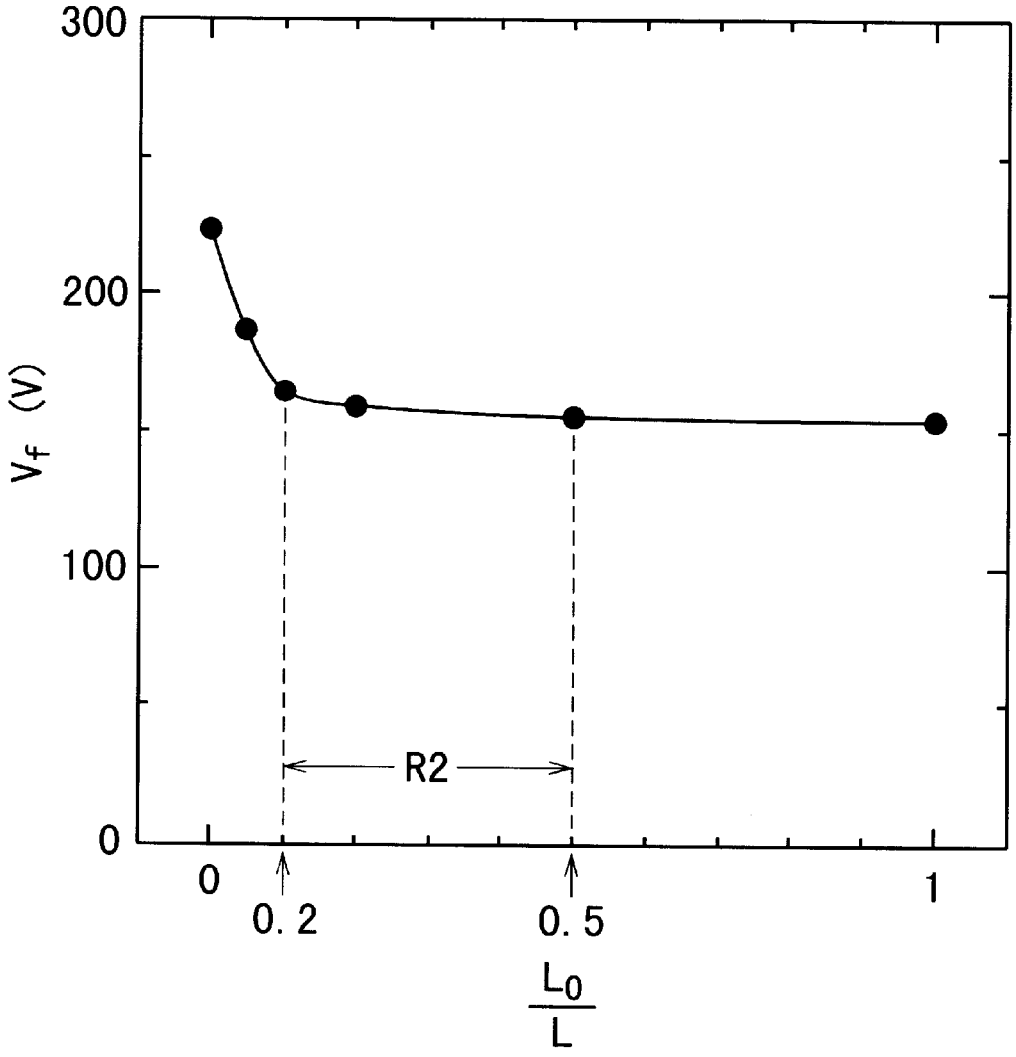
FIG. 32 is a graph showing the relationship between the voltage $V_6$ and the ratio ($L_0$/L) of the surface-discharge type PDP according to the first embodiment of FIG. 3.

The improvement of the efficiency was clearly seen when the ratio ($L_0$/L) was in the range R2 from 0.2 to 0.5 in FIG. 32. As seen from FIG. 32, if ($L_0$/L) is equal to or greater than 0.2, the discharge-starting voltage $V_f$ (V) can be lowered. However, if ($L_0$/L) is greater than 0.5, the light-emitting efficiency is lowered.

Also, when the main constituent of the discharge gas for emitting UV light was Xe, Kr, Ar, or $N_2$, the above-described advantages were found under the condition that the partial pressure of the main constituent was 30 Torr or higher and the composition ratio of this constituent was 6% or higher.

In the PDPs according to the second to sixth embodiments, the same results about the discharge-sustaining voltage and the light-emitting efficiency as those in the first embodiment were found.

Moreover, in the PDP according to the seventh embodiment, the same results about the discharge-sustaining voltage and the light-emitting efficiency as those in the first embodiment were found. The improvement of the efficiency was clearly seen when the ratio ($d_0$/g) was 0.04 to 0.1. The improvement of this efficiency was clearly seen when the ratio ($d_0$/d) was 0.5 to 0.7 and when the ratio ($L_0$/L) was 0.2 to 0.5.

In the PDPs according to the eight to twenty-first embodiments, the same results about the discharge-sustaining voltage and the light-emitting efficiency as those in the first embodiment were found.

VARIATIONS

In the present invention, each pair of the strip-shaped sustain electrodes need not to be located on a same flat plane. One of the pair of the strip-shaped sustain electrodes may be located on a surface and the other is located on another surface having a different height. Each pair of the strip-shaped sustain electrodes need not to have an equal width and thickness. They may be different in width and thickness. They may be asymmetric in shape and/or arrangement.

The overlapped parts of the dielectric layer having the minimum thickness need not be located at the inner ends of the pair of sustain electrodes. They may be located at any positions other than the inner ends of the pair of sustain electrodes.

Any combination of the least two ones of the above-described first to twenty-first embodiments that are not shown in this specification is/are included in the scope of the present invention.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A plasma display panel comprising:

a first substrate;

a second substrate coupled with said first substrate to form a specific gap between inner surfaces of said first and second substrates;

pairs of first and second sustain electrodes formed on or over the inner surface of said first substrate; said pairs of first and second sustain electrodes extending in a first direction and arranged at a specific pitch in a second direction perpendicular to the first direction; each of said pairs of first and second sustain electrodes being apart from each other at a specific gap;

a first dielectric layer formed on or over the inner surface of said first substrate to cover said pairs of first and second sustain electrodes;

selection electrodes formed on or over the inner surface of said second substrate to extend in the second direction; said selection electrodes being arranged in the first direction at a specific pitch;

a second dielectric layer formed on or over the inner surface of said second substrate to cover said selection electrodes;

partition walls formed in said gap between the inner surfaces of said first and second substrates to extend in the second direction; said partition walls being arranged in the second direction at a specific pitch to form discharge spaces in said gap;

fluorescent layers formed respectively in said discharge spaces; and a discharge gas introduced in said discharge spaces;

wherein an overlapping part of said first dielectric layer with said first sustain electrode has a non-uniform thickness in a widthwise direction of said first sustain electrode, and an overlapping part of said first dielectric layer with said second sustain electrode has a non-uniform thickness in a widthwise direction of said second sustain electrode.

2. The panel as claimed in claim 1, wherein said overlapping part of said first dielectric layer with each of said first sustain electrodes has an inner end part thinner than the rest, and said overlapping part of said first dielectric layer with each of said second sustain electrodes has an inner end part thinner than the rest.

3. The panel as claimed in claim 1, wherein each of said first sustain electrodes has an inner end part raised from said the inner surface of said first substrate, and each of said second sustain electrodes has an inner end part raised from the said inner surface of said first substrate.

4. The panel as claimed in claim 1, wherein said first dielectric layer has a flat surface at an opposite side to said first substrate.

5. The panel as claimed in claim 1, wherein said first dielectric layer has depressions on its surface at an opposite side to said first substrate;

each of said depressions is located to be overlapped with inner parts of said first and second sustain electrodes in each of said pairs.

6. The panel as claimed in claim 1, wherein each of said first sustain electrodes has an inner end part raised from said the inner surface of said first substrate, and each of said second sustain electrodes has an inner end part raised from said the inner surface of said first substrate;

and wherein said first dielectric layer has depressions on its surface at an opposite side to said first substrate; each of said depressions being located to be overlapped with said inner parts of said first and second sustain electrodes in each of said pairs.

7. The panel as claimed in claim 1, wherein the inner surface of said first substrate has protrusions to raise inner end parts of said pairs of first and second sustain electrodes toward said second substrate.

8. The panel as claimed in claim 7, wherein said protrusions of said first substrate are made of a low melting-point glass.

9. The panel as claimed in claim 8, wherein said first dielectric layer is made of a dielectric material containing a low melting-point glass as its main constituent;

and wherein said low melting-point glass of said protrusions of said first substrate has a softening point higher than that of said low melting-point glass of said first dielectric layer.

10. The panel as claimed in claim 8, wherein said protrusions of said first substrate has a dielectric constant lower than that of said first dielectric layer.

11. The panel as claimed in claim 1, wherein when said specific gap in each of said pairs of first and second sustain electrodes is defined as g and said first dielectric layer has a minimum thickness $d_0$, a ratio ($d_0/g$) is in a range from 0.04 to 0.1.

12. The panel as claimed in claim 1, wherein when said first dielectric layer has a minimum thickness $d_0$ and the rest of said first dielectric layer has a constant thickness d, a ratio ($d_0/d$) is in a range from 0.5 to 0.7.

13. The panel as claimed in claim 1, wherein when said pairs of first and second sustain electrodes have a width L, and inner end parts of said pairs of first and second sustain electrodes where said first dielectric layer has a decreased thickness have a width $L_0$, ($L_0/L$) is in a range from 0.2 to 0.5.

14. The panel as claimed in claim 1, further comprising a protection layer for protecting said first dielectric layer;

said protection layer covers at least inner end parts of said pairs of first and second sustain electrodes.

15. The panel as claimed in claim 14, wherein said protection layer is made of an oxide of alkaline earth metal.

16. The panel as claimed in claim 14, further comprising a fluorescent layer formed on said first dielectric layer;

wherein said fluorescent layer covers an exposed area of said first dielectric layer from said protection layer;

said fluorescent layer being capable of excitation by UV light emitted from said discharge spaces.

17. The panel as claimed in claim 1, wherein a gaseous constituent emitting UV light of said discharge gas is one selected from the group consisting of Xe, Kr, Ar, and $N_2$;

and wherein said constituent has a partial pressure of 30 Torr or higher and a composition ratio of 6% or greater.

18. A method of fabricating a plasma display panel, said panel comprising:

a first substrate;

a second substrate coupled with said first substrate to form a specific gap between inner surfaces of said first and second substrates;

pairs of first and second sustain electrodes formed on or over the inner surface of said first substrate; said pairs of first and second sustain electrodes extending in a first direction and arranged at a specific pitch in a second direction perpendicular to the first direction; each of said pairs of first and second sustain electrodes being apart from each other at a specific gap;

a first dielectric layer formed on or over the inner surface of said first substrate to cover said pairs of first and second sustain electrodes;

selection electrodes formed on or over the inner surface of said second substrate to extend in the second direction; said selection electrodes being arranged in the first direction at a specific pitch;

a second dielectric layer formed on or over the inner surface of said second substrate to cover said selection electrodes;

partition walls formed in said gap between the inner surfaces of said first and second substrates to extend in the second direction; partition walls being arranged in the second direction at a specific pitch; said partition walls forming discharge spaces in said gap;

fluorescent layers formed respectively in said discharge spaces; and a discharge gas introduced in said discharge spaces;

wherein an overlapping part of said first dielectric layer with said first sustain electrode has a non-uniform thickness in a widthwise direction of said first sustain electrode, and an overlapping part of said first dielectric layer with said second sustain electrode has a non-uniform thickness in a widthwise direction of said second sustain electrode;

said method comprising the steps of:

(a) forming protrusions on said inner surface of said first substrate to extend said first direction and to be arranged at a specific pitch in said second direction;

(b) forming said pairs of first and second sustain electrodes extending in the first direction on said inner surface of first substrate to be overlapped with said protrusions; and (c) forming said first dielectric layer on said inner surface of the first substrate to cover said pairs of first and second sustain electrodes in such a way that said overlapping part of said first dielectric layer with said first sustain electrode has a non-uniform thickness in a widthwise direction of said first sustain electrode and said overlapping part of said first dielectric layer with said second sustain electrode has a non-uniform thickness in a widthwise direction of said second sustain electrode.

19. The method as claimed in claim 18, wherein said step (a) of forming said protrusions on said inner surface of said first substrate is carried out by selectively etching said inner surface of said first substrate.

20. The method as claimed in claim 18, wherein said step (a) of forming said protrusions on said inner surface of said first substrate is carried out by forming selectively a dielectric layer on said inner surface of said first substrate by using a printing or sand-blasting process.

21. The method as claimed in claim 18, wherein said step (a) of forming said protrusions on said inner surface of said first substrate is carried out by forming a dielectric layer on said inner surface of said first substrate and by patterning said dielectric layer thus formed.

22. The method as claimed in claim 18, wherein said step (a) of forming said protrusions on said inner surface of said first substrate is carried out by forming a photosensitive resin layer on said inner surface of said first substrate, by forming windows in said photosensitive resin layer, by filling a dielectric material into said windows, and by removing said photosensitive resin layer to leave said dielectric material filled into said windows.

23. The method as claimed in claim 18, wherein said step (c) of forming said first dielectric layer on said inner surface of said first substrate is carried out by forming a dielectric paste layer on said inner surface of said first substrate, by sintering said dielectric paste layer, and by planarizing a surface of said sintered dielectric paste layer.

24. The method as claimed in claim 23, wherein said step of planarizing said surface of said sintered dielectric paste layer is carried out by polishing.

25. The method as claimed in claim 18, wherein said step (c) of forming said first dielectric layer on said inner surface of said first substrate is carried out by forming a dielectric paste layer with a flat surface of said inner surface of said first substrate, and by sintering said dielectric paste layer.

26. The method as claimed in claim 18, further comprising a step of forming depressions on a surface of said first dielectric layer at an opposite side to said first substrate;

wherein each of said depressions is located to be overlapped with said inner parts of said first and second sustain electrodes in each of said pairs.

27. A method of fabricating a plasma display panel, said panel comprising:

a first substrate;

a second substrate coupled with said first substrate to form a specific gap between inner surfaces of said first and second substrates;

pairs of first and second sustain electrodes formed on or over the inner surface of said first substrate; said pairs of first and second sustain electrodes extending in a first direction and arranged at a specific pitch in a second direction perpendicular to the first direction; each of said pairs of first and second sustain electrodes being apart from each other at a specific gap;

a first dielectric layer formed on or over the inner surface of said first substrate to cover said pairs of first and second sustain electrodes;

selection electrodes formed on or over the inner surface of said second substrate to extend in the second direction; said selection electrodes being arranged in the first direction at a specific pitch;

a second dielectric layer formed on or over the inner surface of said second substrate to cover said selection electrodes;

partition walls formed in said gap between the inner surfaces of said first and second substrates to extend in the second direction; partition walls being arranged in the second direction at a specific pitch; said partition walls forming discharge spaces in said gap;

fluorescent layers formed respectively in said discharge spaces; and a discharge gas introduced in said discharge spaces;

wherein an overlapping part of said first dielectric layer with said first sustain electrode has a non-uniform thickness in a widthwise direction of said first sustain electrode, and an overlapping part of said first dielectric layer with said second sustain electrode has a non-uniform thickness in a widthwise direction of said second sustain electrode;

said method comprising the steps of:

(a) forming said pairs of first and second sustain electrodes extending in the first direction on said inner surface of said first substrate; and (b) forming said first dielectric layer on said inner surface of the first substrate to cover said pairs of first and second sustain electrodes;

said first dielectric layer having depressions on its surface at an opposite side to said first substrate; and each of said depressions being located to be overlapped with said inner parts of said first and second sustain electrodes in each of said pairs.

28. The method as claimed in claim 27, wherein said step (b) of forming said first dielectric layer on said inner surface of said first substrate is carried out by forming a dielectric paste layer on said inner surface of said first substrate, by sintering said dielectric paste layer, and by etching said sintered dielectric paste layer.

29. The method as claimed in claim 27, wherein said step (b) of forming said first dielectric layer on said inner surface of said first substrate is carried out by stacking dielectric paste layers with windows on each inner surface of said first substrate, and by sintering said dielectric paste layer, thereby forming said depressions by combination of said windows of said stacked dielectric paste layers.

* * * * *